US005969352A

United States Patent [19]

French et al.

[11] Patent Number: 5,969,352

[45] Date of Patent: Oct. 19, 1999

[54] SPRAY CHAMBER WITH DRYER

[75] Inventors: John B. French, Oakville; Bernard Etkin; Raymond Jong, both of North York; Guy Légère, Barie, all of Canada

[73] Assignee: MDS Inc., Ontario, Canada

[21] Appl. No.: 08/974,957

[22] Filed: Nov. 20, 1997

Related U.S. Application Data

[63] Continuation-in-part of application No. 08/788,593, Jan. 3, 1997, abandoned.

[51] Int. Cl.[6] ..... H01J 49/36

[52] U.S. Cl. ..... 250/288

[58] Field of Search ..... 250/288, 288 A, 250/423 R, 281, 282

[56] References Cited

U.S. PATENT DOCUMENTS

| | | | |
|---|---|---|---|
| 4,861,988 | 8/1989 | Henion et al. . | |
| 4,958,529 | 9/1990 | Vestal . | |
| 4,990,740 | 2/1991 | Meyer . | |
| 5,122,670 | 6/1992 | Mylchreest et al. . | |
| 5,170,052 | 12/1992 | Kato . | |
| 5,308,977 | 5/1994 | Oishi et al. | 250/288 |
| 5,345,079 | 9/1994 | French et al. . | |
| 5,477,048 | 12/1995 | Nakagawa et al. . | |
| 5,526,682 | 6/1996 | Jarrell et al. . | |

FOREIGN PATENT DOCUMENTS

| | | |
|---|---|---|
| 2104180 | 2/1995 | Canada . |
| 0 560 537 A1 | 9/1993 | European Pat. Off. . |

OTHER PUBLICATIONS

"Use of an multi–tube Nafion membrane dryer for desolvation with thermospray sample introduction to inductively coupled plasma–atomic emission spectrometry", by Jinfu Yang et al., *Spectrochimica Acta* Part B 51 (1996), pp. 1491–1503.

"Fast–Clearing Spray Chamber for ICP–AES", by Guy Légère and Eric D. Salin, *Applied Spectroscopy*, vol. 48, No. 6, 1994, pp. 761–765.

"Determination of Trace Metals in Freshwaters by Inductively Coupled Argon Plasma Atomic Emission Spectrometry with a Heated Spray Chamber and Desolvation", by Peter D. Goulden and Donald H.J. Anthony, *Analytical Chemistry*, vol. 54, No. 11, Sep. 1982, pp. 1678–1681.

"Characterization of a membrane interface for sample introduction into atom reservoirs for analytical atomic spectrometry", by Anders Gustavsson, *Spectrochimica Acta*, vol. 43B, No. 8, 1988, pp. 917–922.

"Inductively Coupled Plasma–Optical Emission Analytical Spectrometry: A Compact Facility for Trace Analysis of Solutions", by Robert H. Scott et al., *Analytical Chemistry*, vol. 46, No. 1, Jan. 1974, pp. 75–80.

(List continued on next page.)

*Primary Examiner*—Kiet T. Nguyen
*Attorney, Agent, or Firm*—Bereskin & Parr

[57] ABSTRACT

A spray chamber for producing a sample for an analyzer which may contain a plasma torch. In the chamber, a heated sheath gas is fed into the periphery of the spray surrounding the spray, adjacent the origin of the spray, thus reducing the size of droplets which are recirculated, thereby reducing agglomeration of the droplets and promoting rapid drying of the spray. Preferably all of the spray solvent is evaporated in a very short chamber, thus further reducing the amount of spray recirculated, and all of the combined flow of dried particulates from the spray, nebulizing gas and sheath gas is directed into the torch. In one embodiment, the central core of the combined flow is directed to the torch and the peripheral portion of the combined flow is ducted to waste. In another embodiment the aqueous spray solvent is fully evaporated before it leaves the spray chamber, and the combined flow is directed through a membrane dryer before reaching the torch, to remove most of the water vapor from the flow and thus to reduce water vapor loading on the torch.

28 Claims, 22 Drawing Sheets

OTHER PUBLICATIONS

"The performance of a low consumption thermospray nebulizer for specific use in micro–HPLC and general use in FI with ICP–AES detection", by J.W. Elgersma et al., *Spectrochimica Acta.*, vol. 46B, No. 6/7, 1991, pp. 1073–1088.

"Optimisation and Evaluation of a Sample Introduction Device for Inductively Coupled Plasma Atomic Emission Spectrometry Using Thermospray Nebulisation", by Koen A. Vermeiren et al., *Journal of Analytical Atomic Spectrometry*, vol. 3, Jun. 1988, pp. 571–577.

"Characterization of an Ultrasonic Nebulizer–Membrane Separation Inferface with Inductively Coupled Plasma Mass Spectrometry for the Determination of Trace Elements by Solvent Extraction", by I.B. Brenner et al., *Journal of Analytical Atomic Spectrometry*, Mar. 1997, vol. 12, pp. 273–279.

"Characterization of an interface for sample introduction into an inductively coupled plasma", by Anders Gustavsson, *Spectrochimica Acta.*, vol. 42B, Nos. 1/2, 1987, pp. 111–118.

"Arsenic Determination in Saline Waters Utilizing a Tubular Membrane as a Gas–Liquid Separator for Hydride Generation Inductively Coupled Plasma Mass Spectrometry", By John T. Creed et al., *Journal of Analytical Atomic Spectrometry*, Jul. 1996, vol. 11, pp. 505–509.

"Decrease of Solvent Water Loading in Inductively Coupled Plasma Mass Spectrometry by Using a Membrane Separator", by Hiroaki Tao and Akira Miyazaki, *Journal of Analytical Atomic Spectrometry*, Jan. 1995, vol. 10, pp. 1–5.

"Removal of Organic Solvents by Cryogenic Desolvation in Inductively Coupled Plasma Mass Spectrometry", by Luis C. Alves et al., *Journal of Analytical Atomic Spectrometry*, Mar. 1994, vol. 9, pp. 399–403.

"Reduction of Water Loading Effects in Inductively Coupled Mass Spectrometry by Nafion Membrane Dryer Device", by Neil Fitzgerald, Julian F. Tyson and David A. Leighty, *Journal of Analytical Atomic Spectrometry* , Jan. 1998, vol. 13, pp. 13–16.

SPRAY CHAMBER WITH DRYER

FIELD OF THE INVENTION

This invention is a continuation in part of U.S. patent application, Ser. No. 08/778,593 filed Jan. 3, 1997 entitled "SPRAY CHAMBER", now abandoned.

BACKGROUND OF THE INVENTION

Analyzers using plasma torches have been used for many years for the analysis of components contained in liquid samples. Typically the liquid sample is sprayed in a spray chamber, using pneumatic nebulization, to form a fine mist of droplets. The fine droplets from the mist, and the fine particles which remain when droplets are evaporated, are introduced into the plasma torch where they are vaporized and ionized. Analysis is typically performed by connecting a mass spectrometer or other mass analyzer to the torch to receive ions from the torch, or by spectroscopy, i.e. by optically analyzing light emitted from the plasma.

In apparatus of the kind described, proper design of the sprayer and spray chamber are important to achieve optimum results. Poor design can result in low signal, or an unduly long signal rise time when spraying begins, or an unduly long washout time to clean out the spray chamber before a new sample can be introduced. In addition, some spray chambers waste a high proportion of the sample provided to them.

One example of an apparatus used for providing liquid sample to a plasma torch is shown in U.S. Pat. No. 5,345,079 to John B. French and Bernard Etkin, two of the present inventors. However this device requires the sample be directed in a stream of uniformly sized and spaced droplets. This can in some cases be a more complex and less convenient procedure than simply spraying a nebulized sample, for example as shown in U.S. Pat. No. 4,861,988.

U.S. Pat. No. 5,170,052 shows a method of using nebulizing gas to form a mist from a sample liquid and to inject the mist into a corona discharge. The technique shown in this patent involves heating the gas which is used to nebulize the liquid, an undesirable procedure which can result in breakdown of the molecules to be analyzed and which can also lead to clogging of fine orifices.

U.S. Pat. No. 5,477,048 shows a conventional form of nebulizer in which coarse droplets are sorted by momentum and wasted to a drain, while fine droplets which are able to negotiate a sharp turn are directed to a plasma torch. This approach has the disadvantages of wasting a great deal of sample and producing a relatively low signal. It also can produce severe memory effects and therefore requires lengthy and thorough washout before a new sample solution can be introduced.

Therefore, it is an object of the present invention to provide a new spray chamber and method, in which signal levels can be improved and in which signal rise time, washout time and memory effects may all be reduced. The new spray chamber and method may advantageously be used not only with analyzers which use plasma torches, but also with other kinds of analyzers, e.g. mass analyzers which use atmospheric pressure ionization. The present invention in another aspect relates to the use of the new spray chamber with a dryer.

BRIEF SUMMARY OF THE INVENTION

In one of its aspects the present invention provides apparatus for producing a sample for an analyzer, comprising:

(a) a nebulizer having a liquid spray tube and a nebulizer gas spray tube, for receiving a liquid sample and nebulizer gas and for producing an expanding spray of droplets of said nebulizer liquid mixed with said gas, directed in a predetermined direction, (b) a spray chamber connected to said nebulizer and having an entrance end for receiving said spray and an exit end, (c) said exit end including an outlet adapted to be coupled to said analyzer, for directing sample from said droplets and mixed with said nebulizer gas to said analyzer, (d) said spray having a periphery and having the property of tending to entrain gas surrounding said periphery into said spray, and thereby having the property, when there is insufficient gas supply surrounding said periphery, of tending to recirculate nebulizer gas and droplets from said spray in a direction opposite to said predetermined direction and then back into said spray, (e) at least one port for introducing a sheath gas into said spray chamber, and a sheath gas source connected to said port, (f) a heater for heating said sheath gas, (g) the temperature of said sheath gas being such as to dry at least partially droplets in said spray which may be recirculated, thereby to reduce agglomeration of droplets in the periphery of said spray.

In another aspect the present invention provides a method of producing a sample for an analyzer, comprising:

(a) producing a liquid spray from said sample liquid and from a jet of nebulizing gas, said spray having an expanding shape, in a predetermined direction (b) said spray having a periphery and having the property of tending to entrain gas surrounding said periphery into said spray, and thereby having the property, when there is insufficient gas supplied to said periphery, of tending to recirculate nebulizer gas and droplets from said spray in a direction opposite to said predetermined direction and then back into said spray, (c) directing a flow of sheath into said spray, (d) heating said sheath gas, and (e) providing said sheath gas at a temperature such as to dry at least partially droplets in said spray which may be recirculated, thereby to reduce agglomeration of droplets in the periphery of said spray.

In another aspect the present invention provides a method of producing a sample for an analyzer, comprising:

(a) producing in a spray chamber having an entrance end and an exit end, a spray from a sample liquid and a jet of nebulizing gas, said spray being liquid and aqueous and expanding in shape in a predetermined direction from the entrance end towards the exit end, (b) said spray having a periphery and having the property of tending to entrain gas surrounding said periphery into said spray, and thereby having the property, when there is insufficient gas supplied to said periphery, of tending to recirculate nebulizer gas and droplets from said spray in a direction opposite to said predetermined direction and then back into said spray, (c) directing a flow of sheath gas into said spray, (d) heating said sheath gas, to provide a the temperature of said sheath gas being such as to dry at least partially droplets in said spray which may be recirculated, thereby to reduce agglomeration of droplets in the periphery of said spray, (e) adjusting the flow of gases and said temperature of said sheath gas being adjusted so that all of said droplets have dried to form dried particulates before they reach the exit end of said spray chamber whereby all water vapor of said sample liquid has been fully vaporized at said exit end of said spray chamber;

(f) directing dried particulates from said droplets, and said sheath and nebulizing gases and said water vapor, in a first stream through a membrane dryer to produce a second stream in which at least some water vapor from said first stream has been removed, and (g) directing said second stream to a plasma torch.

Further aspects of the invention will appear from the following description, taken together with the accompanying drawings.

DETAILED DESCRIPTION OF PREFERRED EMBODIMENTS

Figure 1:
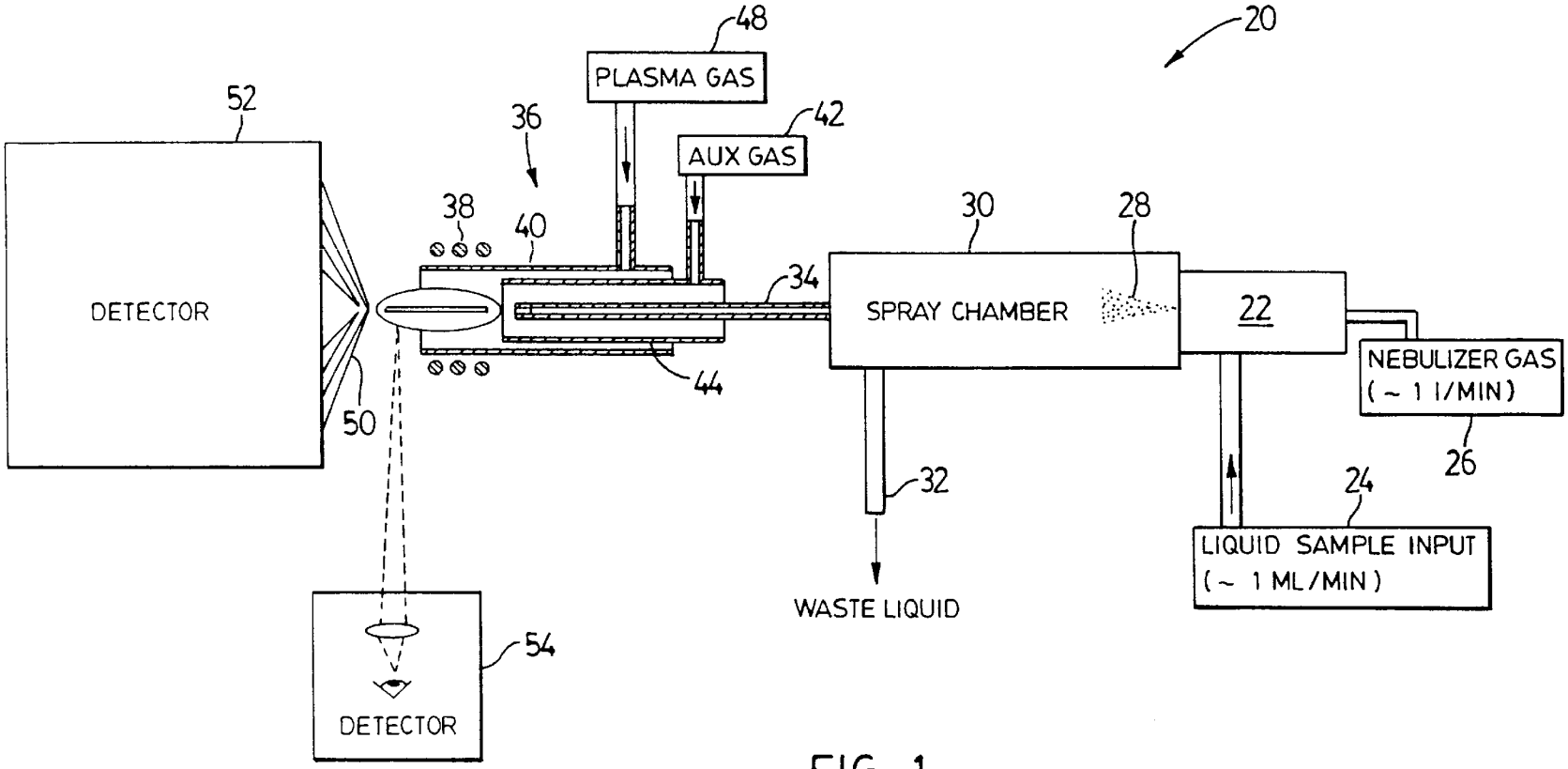
FIG. 1 (PRIOR ART)
FIG. 1 is a diagrammatic view of a conventional prior art inductively coupled plasma analyzer.

Reference is first made to FIG. 1, which shows a conventional analyzing system 20 using a spray chamber. The analyzing system 20 includes a nebulizer 22 which receives liquid sample input from liquid sample source 24 (typically about 1 ml per minute) and nebulizer gas input from a nebulizer gas source 26 (typically argon at a rate of about 1 liter per minute). The nebulizer 22 creates a cone-shaped aerosol spray 28 in a spray chamber 30. Large drops from the aerosol spray 28 are drained off via a drain 32 as waste liquid, while the solvent from the fine aerosol droplets wholly or partly evaporates, leaving small dried particles and remaining fine droplets. The mixture of droplets (if any), dried particles and nebulizing gas enters an injector tube 34 and is injected into a plasma torch 36.

The plasma torch 36 is of the well-known inductively coupled type, and is energized by RF power fed to an induction coil 38 encircling an outer plasma tube 40. As is conventional, a low flow of auxiliary gas (usually argon) is fed from source 42 through an intermediate tube 44 into the plasma 46 to improve its ignition characteristics, while an outer flow of gas (again usually argon) from source 48 is directed next to the wall of the plasma tube 40 to protect the tube 40 from high temperatures.

Ions from the plasma may be fed via skimmers 50 into a detector 52 such as a mass analyzer (for example a mass spectrometer, an ion trap, or a time of flight spectrometer) for analysis. Alternatively, the plasma may be optically observed using an optical analyzer 54, again for analysis.

A problem with conventional spray chambers used in apparatus of the kind shown in FIG. 1 is that much of the sample spray is in the form of large droplets, which the plasma 46 is unable to utilize. Since the large droplets must be drained off, this creates a problem with waste disposal and also results in reduced signal levels. In addition, since the interior of the spray chamber is wetted with liquid, the washout time before the correct data can be obtained from a new sample is long, and memory effects are very large.

Figure 2:
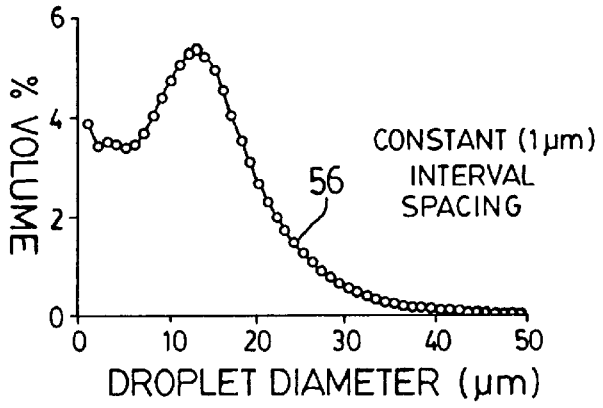
FIG. 2 (PRIOR ART)
FIG. 2 is a graph showing the relative distribution of droplet diameters with a conventional sprayer.

Reference is next made to FIG. 2, in which curve 56 shows droplet size distribution with a typical conventional cross flow nebulizer. It will be seen that the bulk of the droplet diameters are between approximately 10 and 20 $\mu$m, which is undesirable since droplets less than 10 $\mu$m diameter are most useful for the plasma 46. It will be seen by looking at the area under the graph of FIG. 2 that the percentage of droplets in the spray which are under 10 $\mu$m in diameter is only 20 to 30 percent of the total volume sprayed. Even this proportion of the volume does not normally reach the plasma 46, because as will be explained, when the liquid is sprayed into a confined volume such as a spray chamber, the droplets tend to agglomerate, which increases their size.

Figure 3A:
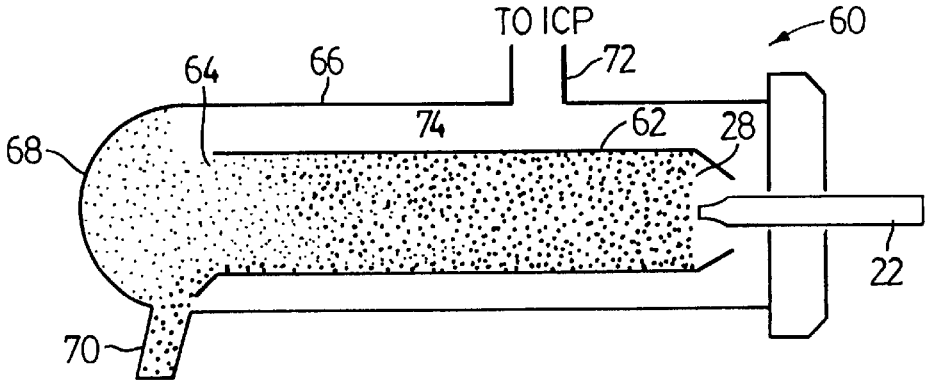
FIG. 3A (PRIOR ART)
FIG. 3A is a diagrammatic view of a conventional spray chamber.

FIG. 3A shows a conventional spray chamber 60 which is currently in widespread use and which is known as the "Scott-Type Double Pass" spray chamber. The spray chamber 60 contains an inner tube 62 which receives the spray 28 from the nebulizer 22. The inner tube 62 has an open exit end 64 and is encircled by an outer tube 66 having a far end 68 with a lower drain 70. The outer tube 66 also has an upper exit tube 72 connected to the torch injector tube 34. In the Scott spray chamber 60, fine droplets and the small dried particles are able to negotiate the turn from inner tube 62 to the exit 72, and more of the fine droplets evaporate in or before reaching the annular space 74 between inner and outer tubes 62, 66. The sample of fine droplets and particles is then directed to the torch 36. Large droplets strike the far end 68 and drain out via drain 70. While the Scott double pass spray chamber 60 is probably the most commonly used spray chamber currently in use, it wastes a great deal of liquid sample, and in addition, as will be explained, it provides a high degree of mixing and collision for the droplets, causing them to agglomerate to form larger droplets, which is undesirable.

Figure 3B:
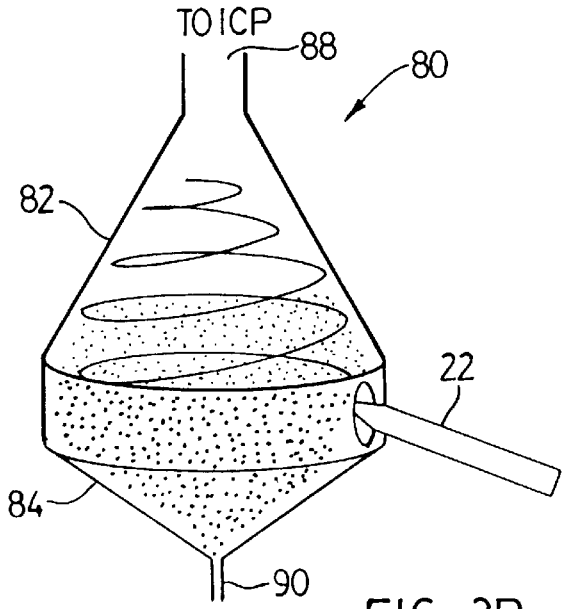
FIG. 3B (PRIOR ART)
FIG. 3B is a diagrammatic view of another form of conventional spray chamber.

FIG. 3B shows a conventional cyclonic spray chamber 80, of circular cross section and having upper and lower cone formations 82, 84. The nebulizer 22 sprays generally tangentially into the central or largest diameter portion 86 of the spray chamber 80, setting up a cyclonic action within the volume of the chamber. Small droplets, because of their lightness, are carried by the main gas flow and rise toward the top and exit. The aerosol (vapor, droplets and particles) is directed through exit opening 88 and injector tube 34 to the plasma torch 36. Large droplets travel under the action of centrifugal force to the boundaries of the chamber 80, strike the walls, and flow down the walls of the lower conical formation 84 to a bottom drain 90. A problem with the cyclonic spray chamber 80 is that the flow in it is turbulent rather than laminar, so that the droplets undergo numerous collisions with each other and tend to coalesce or grow larger, which is undesirable. In addition, the turbulent flow wets much of the wall surface and also the tip of nebulizer 22 which is located in the chamber, increasing washout times.

Figure 4A:
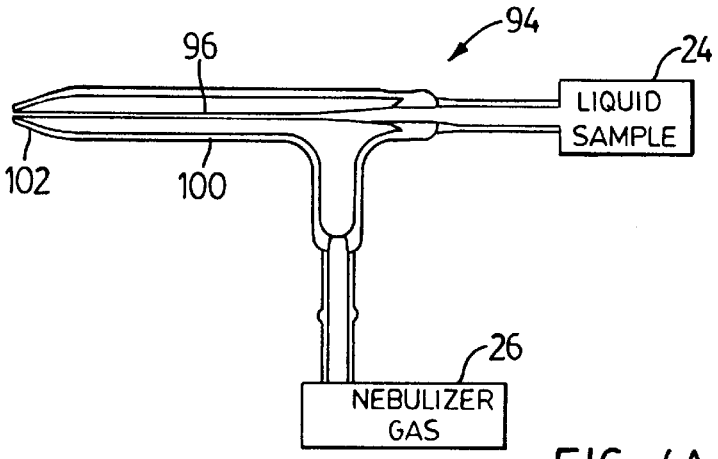
FIG. 4A (PRIOR ART)
FIG. 4A is a diagrammatic view of a known high efficiency nebulizer.

FIG. 4A shows a conventional nebulizer 94, known as the Meinhard high efficiency nebulizer or "HEN". This nebulizer is somewhat pistol-shaped, having a central very small internal diameter tube 96 which receives liquid sample from liquid sample source 24, and having a surrounding outer tube 100 the end of which tapers at 102 to leave a very small surrounding orifice around central tube 96. A nebulizing gas from source 26 is injected into outer tube 100. The HEN nebulizer 94 produces relatively fine droplets, although it can tend to clog depending on the sample being used.

Figure 4B:
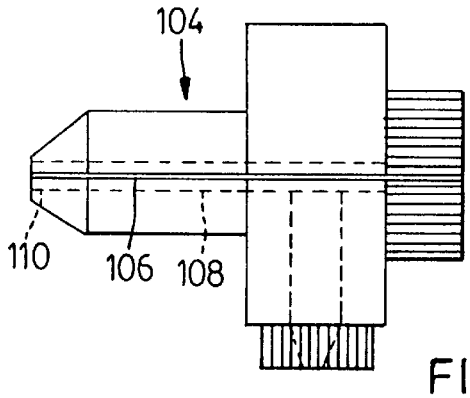
FIG. 4B (PRIOR ART)
FIG. 4B is a diagrammatic view of another known high efficiency nebulizer.

FIG. 4B shows another conventional nebulizer 104 known as the Cetac micro concentric nebulizer or "MCN". The MCN nebulizer also includes a central small internal diameter tube 106 supplied with liquid sample and surrounded by an outer concentric tube 108, which however does not taper at its free end 110. The MCN nebulizer 104 may be slightly less prone to clogging than the HEN nebulizer but produces somewhat coarser drops.

Figure 4C:
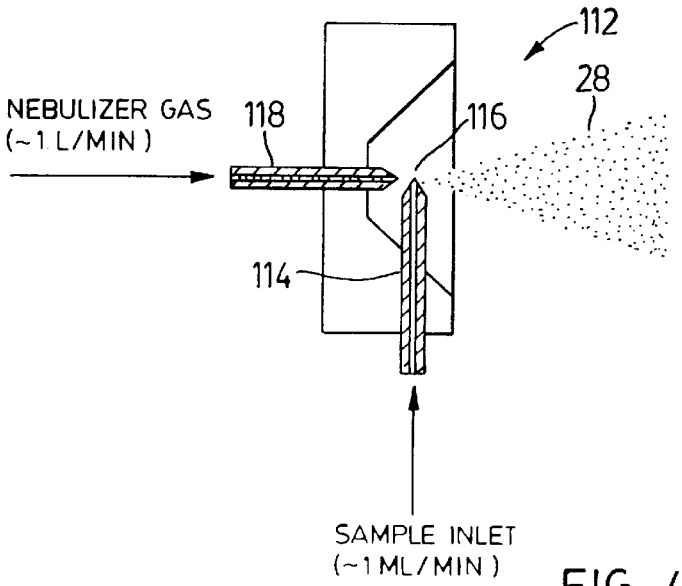
FIG. 4C (PRIOR ART)
FIG. 4C is a diagrammatic view of a conventional cross flow nebulizer.

FIG. 4C shows at 112 a conventional cross flow nebulizer, which is the type most commonly in use. The cross flow nebulizer 112 includes a tube 114 supplied with liquid sample and which directs the sample in a liquid stream from orifice 116, using a pump not shown. A cross directed jet of argon or other desired nebulizing gas from tube 118 nebulizes the sample into an aerosol spray indicated at 28. An advantage of the cross flow nebulizer 112 is that it is the least likely to clog of the three nebulizers described, but it tends to produce larger droplets than the other two nebulizers.

Figure 5:
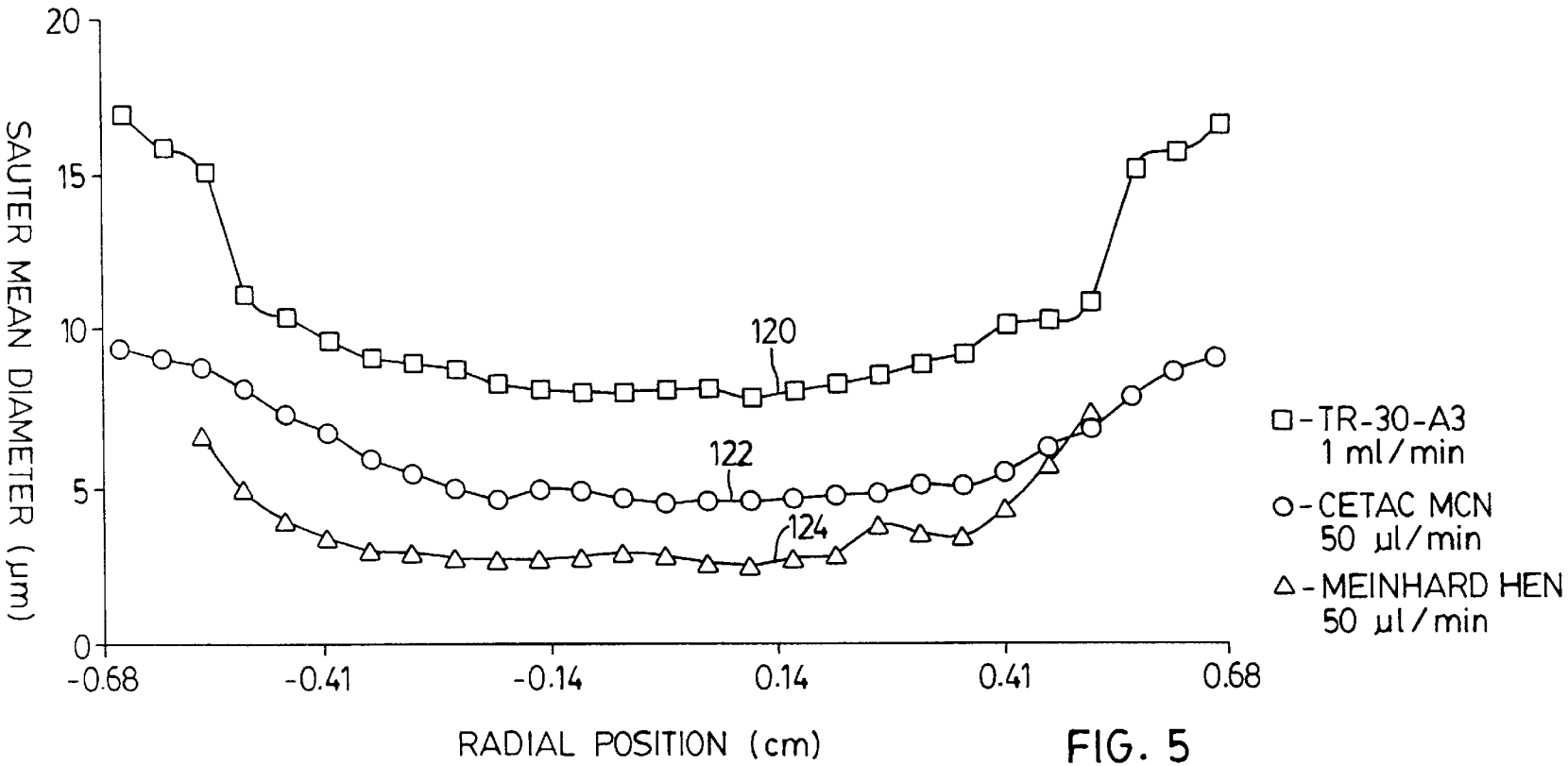
FIG. 5 (PRIOR ART)
FIG. 5 is a chart showing the distribution of droplet sizes with the nebulizer of FIGS. 4A, 4B and 4C.

FIG. 5 is a plot showing droplet size distribution in the sprays produced by the first two nebulizers described, and by a conventional TR-30-A3 nebulizer which is a concentric type of nebulizer having aerosol characteristics similar to those of a cross flow nebulizer. The FIG. 5 plots show droplet size distribution as a function of the radial distance from the axis of the spray and taken approximately 1 cm from the nebulizer nozzle (but measured from the outlet of nebulizing gas tube 118 for the cross flow nebulizer 112). The TR-30-A3 nebulizer is operated at its normal flow rate of 1 ml per minute, while the MCN and HEN nebulizers 104, 94 are each operated at their normal flow rates 50 $\mu$l per minute. The curves for the TR-30-A3, MCN and HEN nebulizers are indicated at 120, 122, 124 respectively.

It will be seen that in all cases, the droplet sizes increase toward the periphery of the spray pattern. One reason why the droplets become larger at the periphery of the spray is that they tend to mix and coalesce in that region, as will be explained.

Bearing in mind that for each annulus about the axis of the spray pattern, the area of the annulus is given by $2\pi r\Delta r$ (where r is the radius and $\Delta r$ is the width of the annulus), the area of the annuli increases with increased radius and therefore the number of larger droplets also increases. The result is that for the TR-30-A3 nebulizer, as shown by curve 120 in FIG. 5, approximately 70 to 80 percent of the total sample sprayed is in the form of droplets whose diameter is above 10 $\mu$m. The MCN and HEN nebulizers, curves 122, 124, are much improved but still have a large proportion of their droplets at or above 10 $\mu$m in diameter.

Figure 6A:
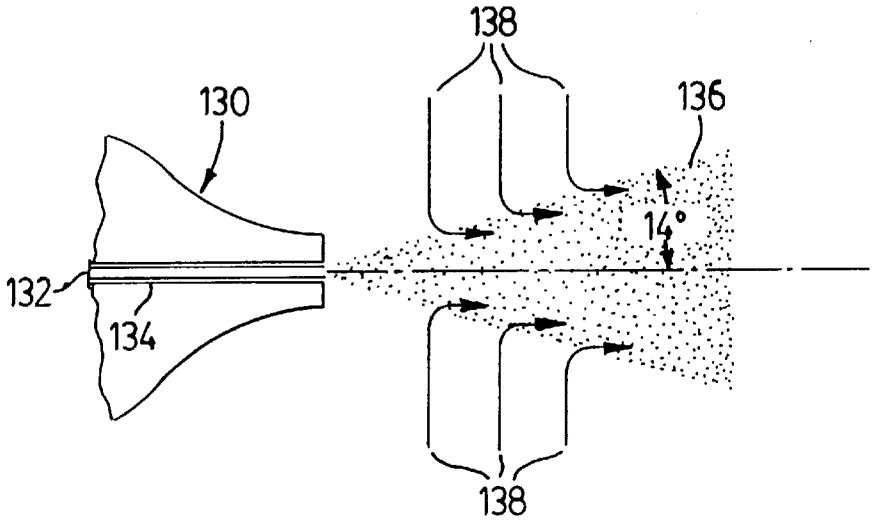
FIG. 6A is a diagrammatic view showing the distribution of a typical aerosol spray from the nebulizer of FIG. 4A and showing surrounding gas entrained therein.
Figure 6B:
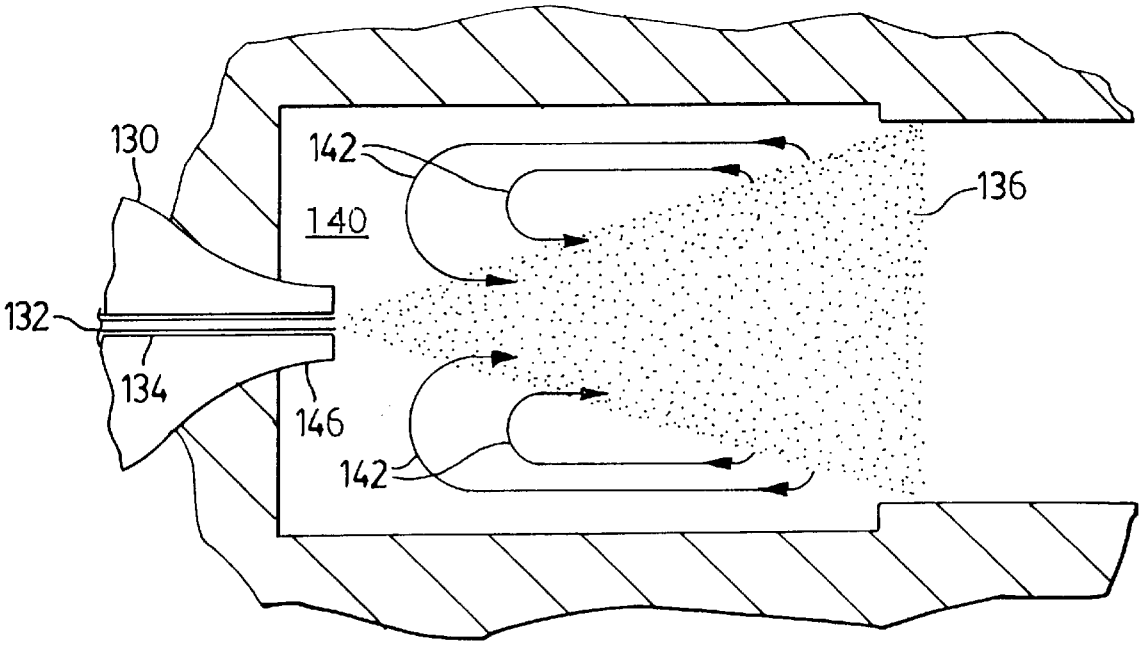
FIG. 6B is a view similar to that of FIG. 6A but showing the aerosol as being confined in a spray chamber and with recirculation.

Reference is next made to FIGS. 6A and 6B, which show certain properties of an aerosol spray, produced by a nebulizer 130 which includes a liquid sample spray tube 132 and a coaxial nebulizing gas tube 134. In FIG. 6A, the aerosol spray 136 is unconfined and is surrounded by free gas (e.g. argon), a portion of which becomes entrained in the spray as indicated by arrows 138. Because the spray is unconfined, no recirculation of any part of the spray occurs. All of its entrainment needs are supplied by the surrounding gas.

When the aerosol spray is formed in a spray chamber 140 as shown in FIG. 6B, there is no free gas to entrain and therefore the spray 136 sends back part of itself to supply the needed recirculating gas. The recirculation patterns are indicated at 142 in FIG. 6B. Unfortunately, it is found that droplets in the periphery of the spray 136 are recirculated back together with recirculated nebulizing gas (both in a direction opposite to the direction of spraying), and that they then rejoin the main spray 136 at a much slower velocity than that of the main spray 136. The slower moving droplets, which are recirculated into the faster moving droplets of the main spray 136, encourage and amplify collisions among the droplets, causing what were previously small droplets to coalesce together and become large droplets. The presence of such large droplets is, as mentioned, extremely undesirable since they will not quickly evaporate and cannot be utilized by the plasma 46.

The recirculation of droplets and their coalescence also adds to memory effects. The recirculating droplets wet not only the walls 144 of the spray chamber 140, but can also wet the nebulizer tip 146, increasing the washout time needed before the data from a new sample is optimum.

Figure 7B:
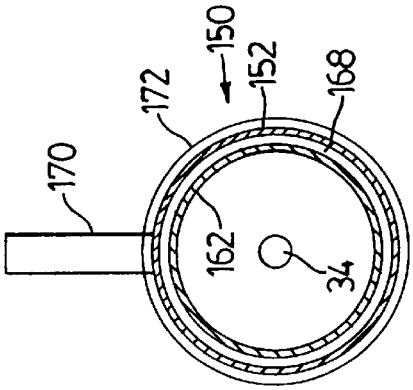
FIG. 7B is a sectional view along lines 7B–7B of FIG. 7A.
Figure 7A:
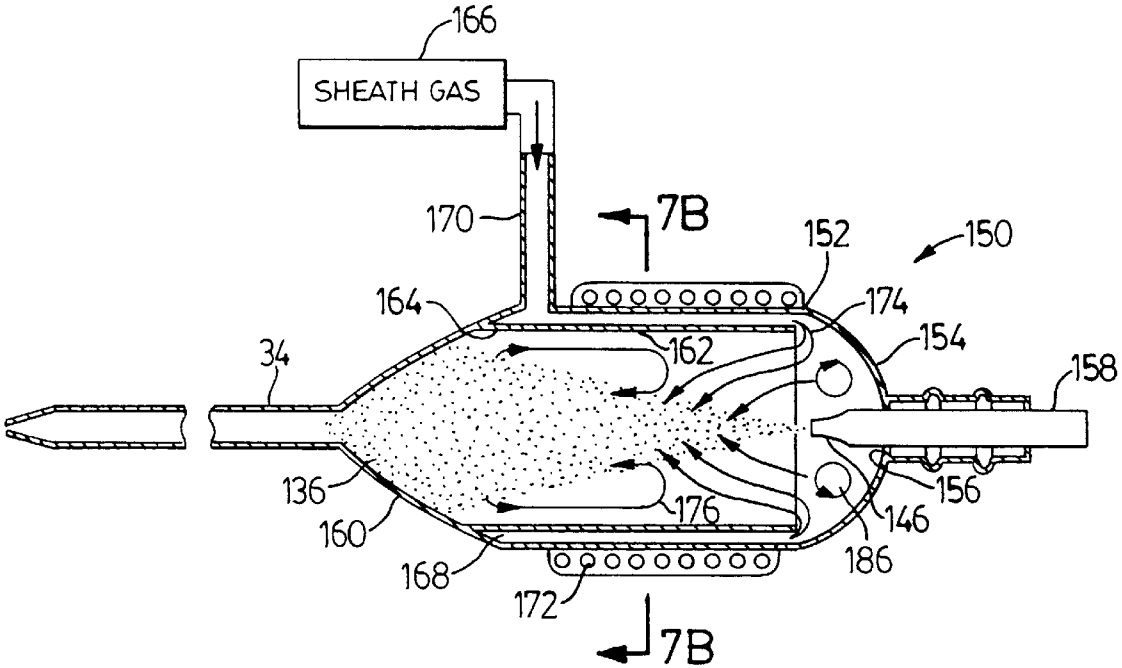
FIG. 7A is a diagrammatic side sectional view showing a spray chamber according to the invention.

Reference is next made to FIGS. 7A and 7B, which show a spray chamber 150 according to the invention. The spray chamber 150 has a generally cylindrical outer wall 152, with a tapered (e.g. curved) entrance end 154 having an axial opening 156 therein, in which is inserted a conventional nebulizer 158. The nebulizer 158 can be any conventional nebulizer but is preferably an MCN or a HEN nebulizer as described.

The spray chamber 150 also includes a tapered exit wall 160 which receives the torch injector tube 34. The nebulizer 158, the spray chamber 150, and the injector tube 34 all preferably have the same axis, but this can vary.

The spray chamber 150 further includes an inner wall or baffle 162 concentric with outer wall 152 and which joins the exit wall 160 at a seal 164. Sheath gas, typically argon as is used in the nebulizer 158, is injected from sheath gas source 166 into the annular space 168 between the outer and inner walls 162, 152 via tube 170. The sheath gas is heated, e.g. by a heat tape 172 wrapped around the outer wall 152, and enters the spray chamber space inside inner wall 162 at a gap 174 between the right hand side of the inner wall 162 as drawn and the outer wall 152.

The sheath gas from source 166 serves to provide some of the gas needed for entrainment by the aerosol spray 156. It is not however practical to supply sufficient auxiliary gas to fill all of the entrainment needs of the aerosol spray 156. Therefore there will still be recirculation from inside the jet, as indicated by arrows 176.

Concerning the relative proportions of gas entrained in the spray, which gases are supplied by (a) the sheath gas, and (b) gas recirculated from the spray itself, it is found that the entrainment of surrounding gas into the periphery of a spray is a complex phenomenon. This phenomenon is affected by a number of factors. These factors may include the flow rate of the liquid which is included in the spray, the cone angle of the spray, and the distance along the axis of the spray from its source.

FIG. 8 is a theoretical curve which shows the variation of spray "flow ratio" with distance from the jet orifice, at a spray cone angle of 30°, and with jet argon flow of 0.2 l/min, for no liquid sample flow (curve 178) and for a liquid sample flow of 1 ml/min (curve 179). The "flow ratio" of the spray is defined as the ratio of:

$$\frac{\text{flow rate of gas entrained by the spray}}{\text{flow rate of nebulizing gas used to produce the spray}}$$

in the absence of recirculation of any part of the spray. In a spray chamber such as chamber 150, the gas entrained by the spray would ideally be fully supplied by the sheath gas from source 166, if sufficient sheath gas could be provided. However this is not normally practical, as indicated by FIG. 8A.

Figure 8A:
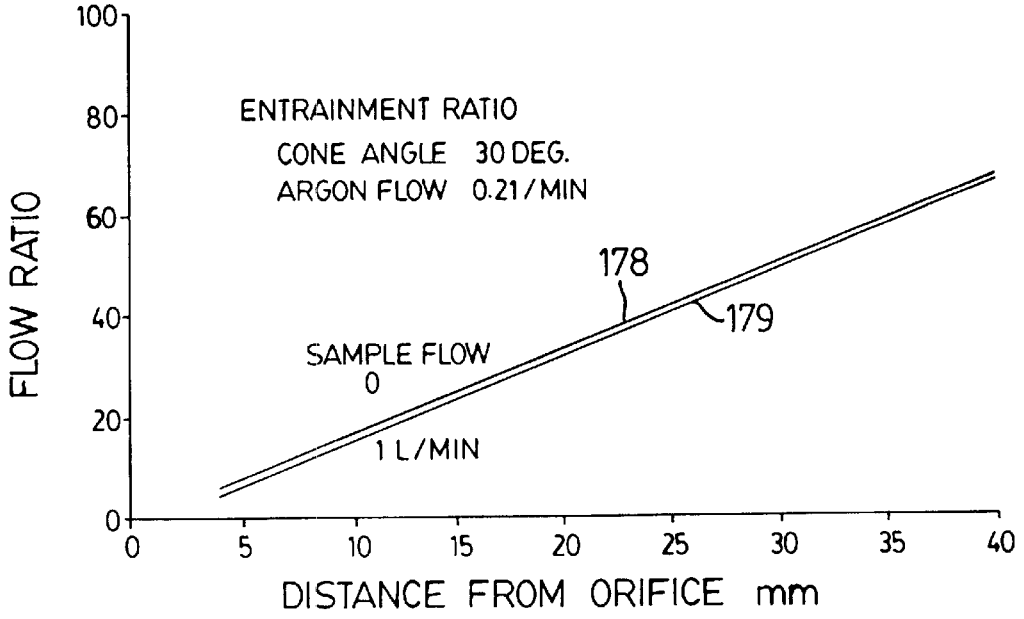
FIG. 8A is a graph showing flow ratios for a spray.

As shown in FIG. 8A, it will be seen that for curve 178, the flow ratio only 40 mm from the orifice is nearly 70, i.e. the amount of gas entrained by the jet is nearly 70 times the original flow of the jet itself. It will also be seen that the flow ratio varies very little when the jet has a liquid core, i.e. when there is sample flow, as indicated by curve 179.

FIG. 8A is a theoretical curve and is believed to understate the flow ratio, i.e. the amount of gas entrained by the jet. Table 1below contains data which is partly experimental and partly calculated, showing jet nozzle size, distance "x" downstream from the jet nozzle, jet flow Q0 (liters/minute), initial jet velocity U (meters/sec), the jet cone half radius or r half (this is the radius at which the axial velocity is half the peak velocity), the jet flow rate Q as augmented by entrainment at the chosen point "x", and the augmentation or AUG. The jet tested was not constrained in a chamber.

TABLE 1

NEBULIZER DATA

| CASE # | NOZ A sq. mm | x, cm. | Q0, l/m | U, m/s | r half, mm | Q, l/m | AUG |
|---|---|---|---|---|---|---|---|
| 3 | 0.008 | 1 | 0.3 | 27.1 | 1.06 | 9.62 | 31.07 |
| 4 | 0.008 | 1 | 0.5 | 29 | 1 | 9.96 | 18.91 |
| 5 | 0.008 | 1 | 0.75 | 27.4 | 1.04 | 9.75 | 12.00 |
| 6 | 0.008 | 1 | 0.3 | 20.4 | 0.872 | 11.02 | 35.73 |
| 7 | 0.00785 | 0.25 | 0.3 | 56.9 | 0.357 | 3.24 | 9.81 |
| 8 | 0.00785 | 0.5 | 0.3 | 40 | 0.5 | 5.6 | 17.68 |
| 9 | 0.00785 | 1 | 0.3 | 20.6 | 0.93 | 12.15 | 39.05 |
| 10 | 0.00785 | 2 | 0.3 | 15.7 | 2.3 | 22.5 | 74 |
| 11 | 0.00785 | 3 | 0.3 | 10.9 | 3.54 | 33.6 | 111 |

It will be seen that according to Table 1, only 3 cm downstream from the jet orifice the flow has increased to 33.6 l/min from 0.3 l/min, i.e. the augmentation has been over 100 times, with the additional gas being added by entrainment. This indicates that it is not practical to supply much of the entrainment needs of the jet, when constrained in a chamber, by sheath gas and that a large amount of recirculation is virtually inevitable.

Figure 8B:
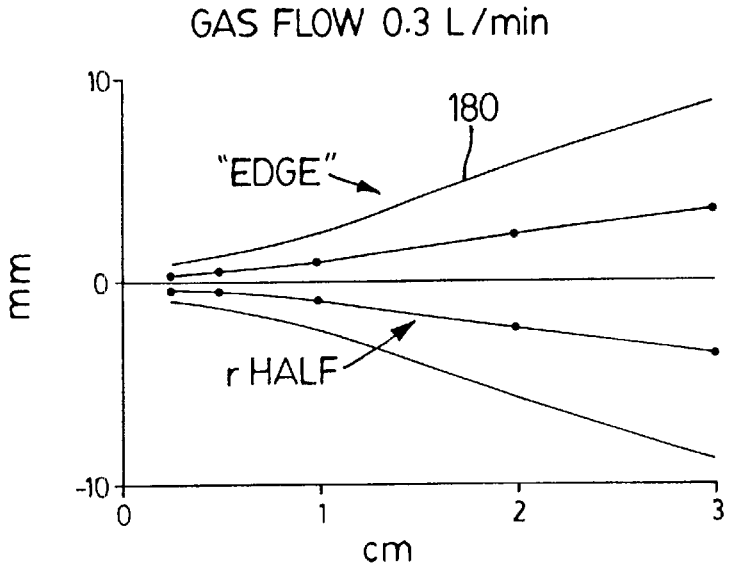
FIG. 8B is a graph showing jet shapes.

Perhaps because of the very large entrainment of gas, it is found that the jet cone angle increases with distance from the orifice, as shown for jet "edge" 180 in FIG. 8B, which shows the jet edge as a function of distance from the orifice.

Figure 8C:
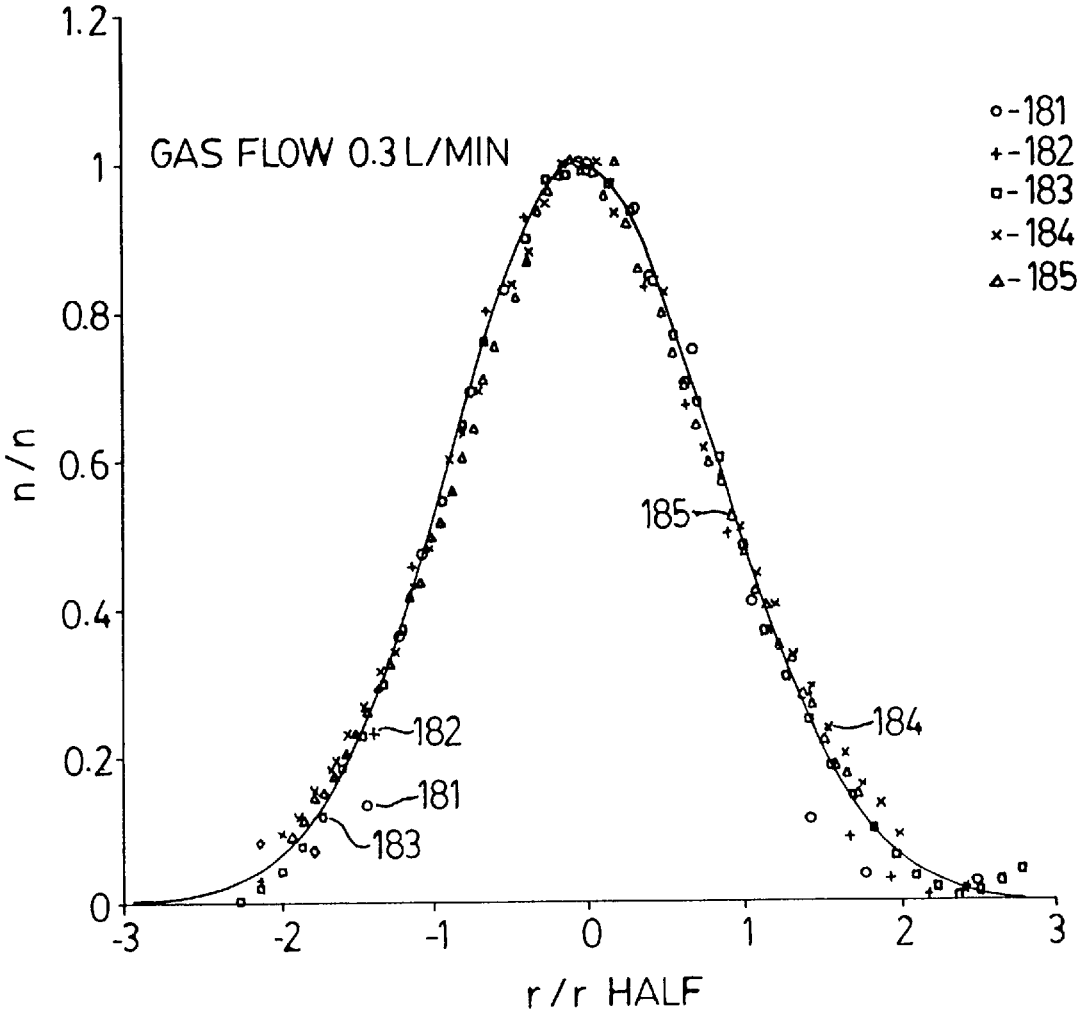
FIG. 8C is a graph showing jet velocity profiles.

Surprisingly, however, it is found as shown in FIG. 8C that the shapes of the velocity profiles of the jet are essentially the same at a variety of distances from the jet orifice, commencing very close to the orifice. In FIG. 8C, curves 181 to 185 show the velocity profiles of the jet for cases 7 to 11 respectively of Table 1. (The velocity profiles show the velocity profiles as a function of radius where u is the axial velocity at radius r, U is the axial velocity along the center line, and r half as mentioned is the radius at which u=½ U.) The fact that the shapes of the velocity profile only 0.25 mm from the orifice is the same as that 3 cm from the orifice indicates that the mixing of jet gas and entrained gas is turbulent, complete and very thorough, even very close to the orifice. Mixing is assisted by donut shaped vortices such as those shown at 186 in FIG. 7A, close to the jet nozzle. Therefore the heated sheath gas has the effect of reducing droplet size at an early stage as the droplets emerge. This is an extremely important factor, as will now be explained.

When the droplets are recirculated in a conventional spray chamber, the recirculating droplets re-enter the jet at a lower velocity than droplets emerging with the jet, and tend to collide with these droplets. When the droplets collide, they coalesce, forming larger droplets which have an even greater likelihood of collisions with other droplets. The result is a tendency of droplets to wet the walls of the spray chamber, and to wet the nebulizer nozzle, and to take too long to evaporate causing memory effects and increased washout time.

If the droplets can be reduced in size as soon as they emerge, by rapidly mixing heated sheath gas with the jet, then they are reduced in size or even fully evaporated to particulates before they are recirculated. The smaller droplets have a lower collision cross-section than larger droplets and are less likely to coalesce and become larger droplets. If they are dried to particulates, the particulates (which are typically of size less than one micron-like smoke) are even less likely to collide with droplets, and even if they do collide, they will not materially increase the size of the droplets. The particulates will also not stick to the chamber or nozzle walls and will therefore not increase memory effects. Since neither the chamber walls nor the nebulizer tip 146 is wetted, memory effects are in fact significantly reduced, as will be seen.

The smaller droplets also permit a higher sample loading of the plasma. When the plasma is required to evaporate less liquid, then the plasma can be shorter and will be more stable, i.e. it is less likely to be extinguished.

In a preferred embodiment of the invention, the nebulizer gas flow rate (which for a high efficiency nebulizer such as the HEN nebulizer 22, is normally 0.5 l/minute at 80 psi, is reduced to 0.2 l/minute at 80 psi. It is found that this produces no adverse effects on the spray produced (in fact the resultant spray has finer droplets with this change). Since the torch injector tube 34 can accept about 1 l/minute of gas flow, this means that the sheath gas flow can be set at about 0.8 l/minute. Thus the ratio of sheath gas flow/nebulizer gas flow is about 4. This is of course much less than the flow ratio. The sheath gas is preferably fed directly into the periphery of the spray 136, around its entire periphery, as shown, but this is not essential since the mixing is so thorough and rapid.

As mentioned, it is undesirable to heat the nebulizing gas since this can cause breakdown of the molecules in the analyte and can cause clogging of the nebulizer. The same problem occurs when the sample liquid is heated. However the sheath gas can be heated (by heat tape 172) without these problems and as discussed, its heat is input directly to the spray 136 where the heat is needed, i.e. at or near the jet orifice (before the droplets have an opportunity to grow). Depending on the material being analyzed, the sheath gas is heated to a temperature in the range 100° C. to 230° C., and preferably between 130° C. and 200° C. As will be shown, this produces good results.

Another feature of the spray chamber 150 of FIGS. 7A and 7B is that it is relatively short. The dimensions in FIG. 7A show typical dimensions of a prototype which was built. It will be seen that in the prototype, the spray chamber was only 76 mm long. This is about one third the length of a conventional spray chamber. Advantages of the shorter length are that there is less opportunity for collisions, less wall surface to wet, and hence smaller memory effects. In addition, since the spray spreads less in a shorter distance, higher signal levels can more readily be achieved. Preferably the sprayed droplets should be fully evaporated before they can hit and wet the exit wall 160, but this is achieved through proper setting of the flow rates of the sample and of the nebulizer and sheath gases and temperature of the sheath gas. A smaller spray chamber also means that there is less volume to washout, even further reducing washout time.

If the droplets from the spray are to be fully evaporated before they can reach the exit end of the spray chamber, then the advantage of heating the sheath gas before the sheath gas enters the spray chamber becomes particularly significant. It has been found that when the droplets become large, they require an exponentially increasing period of time to evaporate. An important reason for this is that the volume of the droplet, and hence the energy needed to evaporate it, increase with the cube of the droplet radius, but the surface area of the droplet (through which the energy is input to evaporate the droplet) increases only with the square of the radius. Therefore, once a droplet becomes large, it becomes impossible in practice to input sufficient energy into it to evaporate the droplet fully in the relatively short length of the spray chamber. A further problem is that the agglomeration process by which the droplets become larger occurs very rapidly downstream of the spray orifice, and the larger a droplet becomes, the greater is its tendency to sweep up (i.e., agglomerate with) smaller droplets.

If the sheath gas entering the spray chamber were unheated and were allowed to acquire heat simply from a heated wall of the spray chamber, it is found that this would not normally be effective to evaporate the droplets. This may be in part because when the sheath gas acquires heat from the wall, it also becomes saturated with water vapor which it has picked up from droplets which have impacted the wall. However, if the sheath gas enters the spray chamber in heated condition, as described, then the turbulence in the spray chamber rapidly mixes the heated sheath gas with the spray. As noted, this evaporates the droplets, or at least reduces their size, and therefore their tendency to agglomerate, very quickly, before they have an opportunity to agglomerate and grow. Therefore the method described is able to evaporate the droplets fully, with suitable parameter adjustment, before the droplets reach the end of the spray chamber.

Figure 9B:
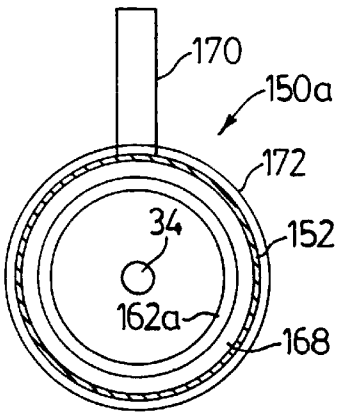
FIG. 9B is a sectional view along lines 9B–9B of FIG. 9A.
Figure 9A:
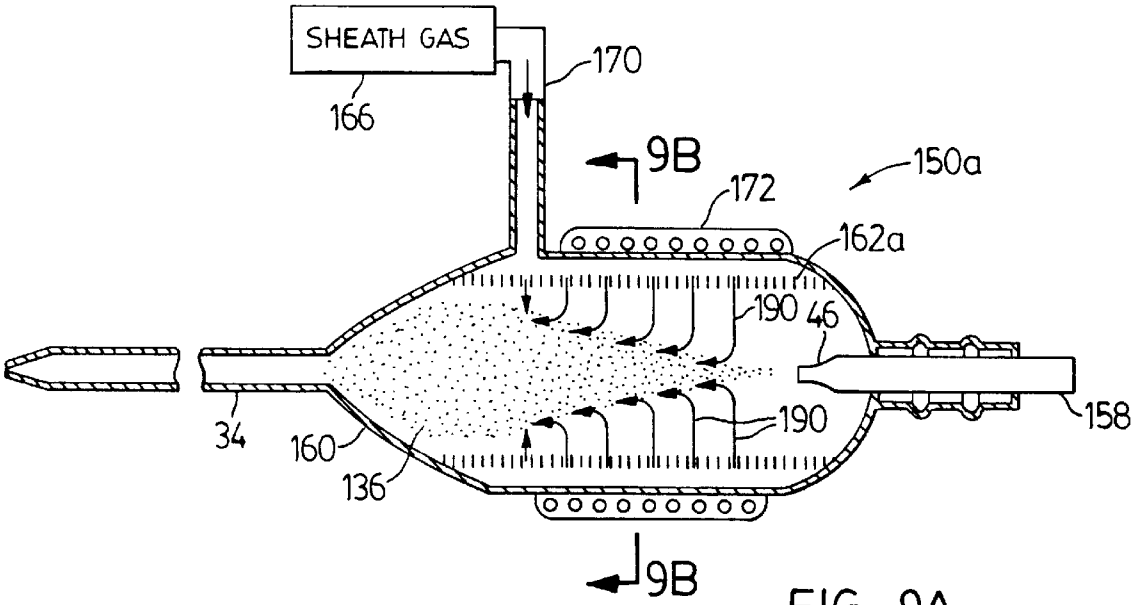
FIG. 9A is a side sectional view of a modified embodiment of a spray chamber according to the invention.

FIGS. 9A and 9B show a modification of the spray chamber 150, marked 150*a*, in which the inner wall or baffle 162 is replaced by a wall 162*a* which is permeable to sheath gas. Typically wall 162*a* is made from a porous ceramic material of the kind commonly used for filters, and which permits a flow of sheath gas to be fed along its length into the spray 156, as indicated by arrows 190. No gap 174 is necessary between entrance wall 154 and the inner wall 162*a*, but such a gap can be provided if desired to allow extra sheath gas to be fed to the initial part of the spray.

In comparison tests it was found that the versions of FIGS. 7A, 7B and 9A, 9B performed equally well and there was no significant difference between them.

Figure 10:
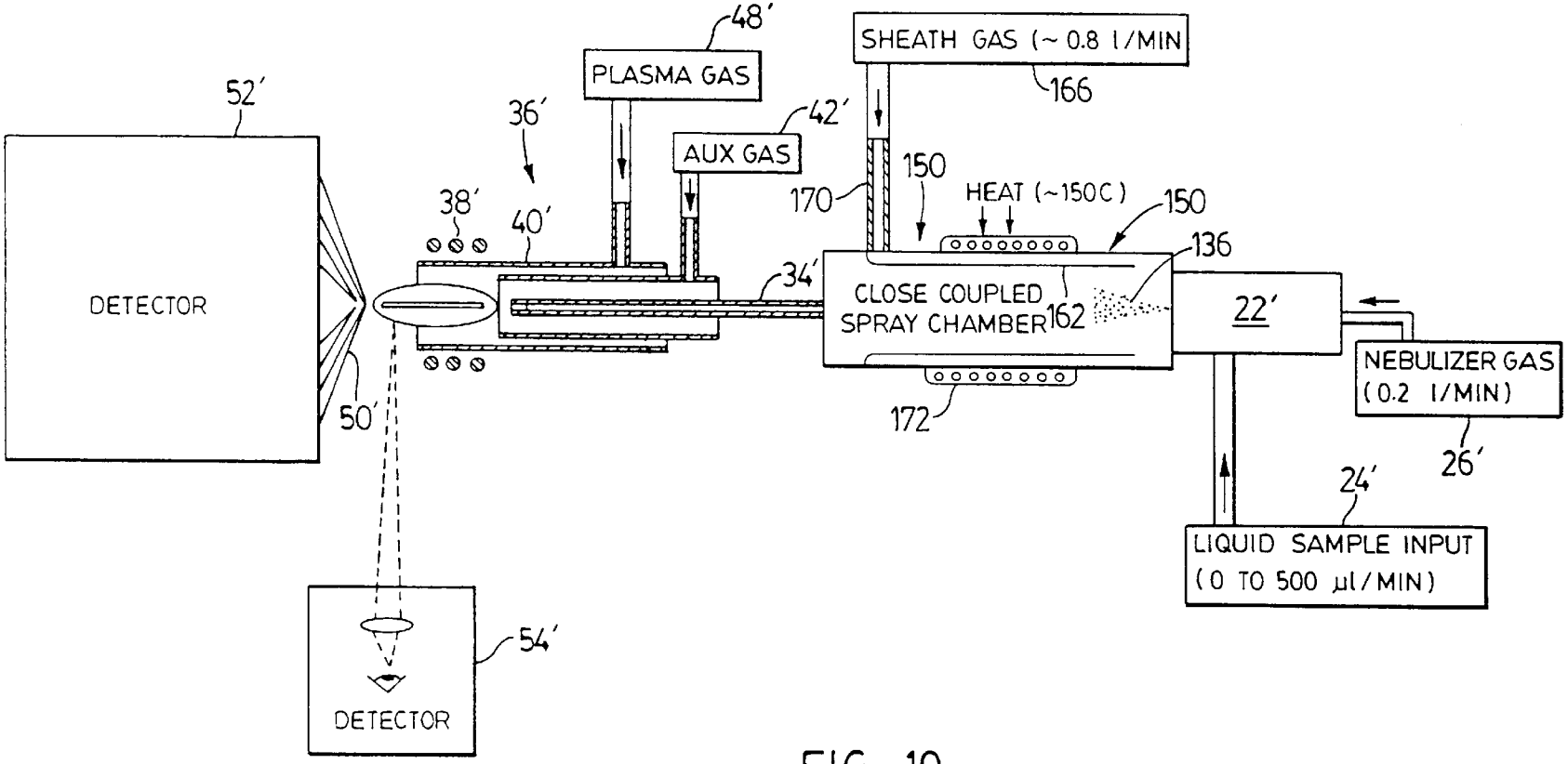
FIG. 10 is a diagrammatic view of the spray chamber of FIGS. 7A and 7B incorporated into an analyzer system.

Reference is next made to FIG. 10, which shows a spray chamber 150 incorporated in a typical analyzer system of the kind shown in FIG. 1. In FIG. 10 primed reference numerals correspond to correspondingly numbered parts in FIG. 1. In the FIG. 10 version, auxiliary gas and plasma gas are still supplied to the torch from sources 42', 48'. However the approximately 1 liter per minute of argon supplied to injector tube 34' is supplied from the spray chamber 150, at a rate of about 0.2 liters per minute from the nebulizer 22' and 0.8 liters per minute from the sheath gas source 166.

Figure 11:
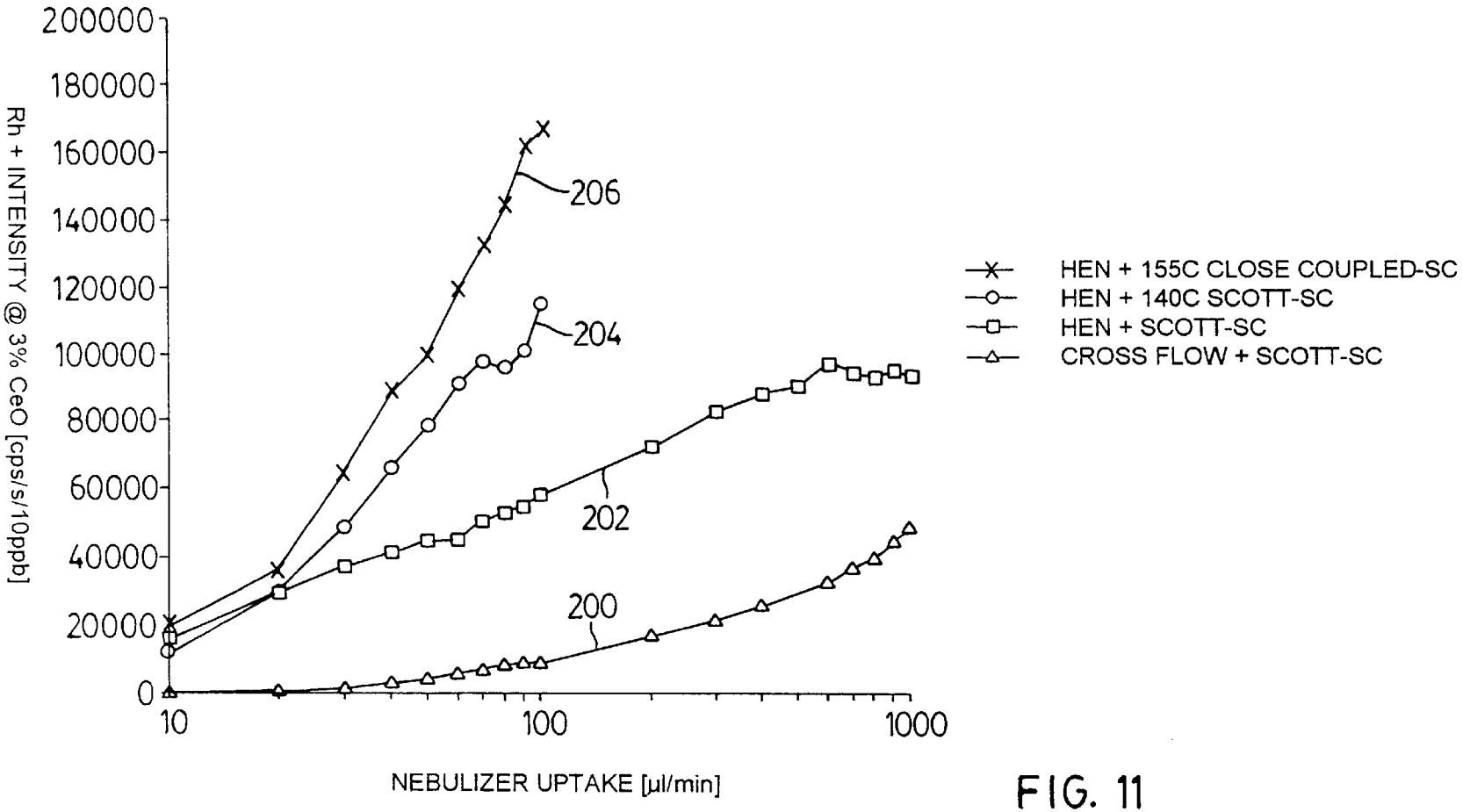
FIG. 11 is a plot showing signal response for several nebulizers using the conventional spray chamber of FIG. 3A and a spray chamber according to the invention.

Reference is next made to FIG. 11, which shows the signal obtained from a mass spectrometer used as the mass analyzer 52' in the FIG. 10 system for four different combinations of nebulizer and spray chamber. The nebulizer liquid sample uptake in micro liters per minute is plotted on the horizontal axis, while the vertical axis shows rhodium intensity in counts per second per 10 parts per billion (optimized at 3% cerium oxide).

Curve 200 shows the signal response obtained for a conventional cross flow nebulizer 112 combined with a Scott type spray chamber of the kind shown at 60 in FIG. 3A. It will be seen that the signal response is relatively low for all ranges of nebulizer uptake.

Curve 202 shows the signal response obtained using a HEN nebulizer (as shown at 94 in FIG. 4A) combined again with a Scott spray chamber of the kind shown at 60 in FIG. 3A. It will be seen that the higher efficiency nebulizer produces a substantially higher signal level, but that the higher signal levels are obtained primarily at higher nebulizer uptake rates.

Curve 204 shows the HEN nebulizer 94 of FIG. 4A used with the Scott spray chamber 60 of FIG. 3A, but with the entire outer wall 66 of the Scott spray chamber 60 wrapped with heating tape to heat the outer gas to approximately 140° C. It will be seen that the signal levels achieved is much improved over curve 202, even at one-tenth the flow sample rate.

Curve 206 shows the HEN nebulizer 94 of FIG. 4A used with the spray chamber 150 of FIGS. 7A, 7B. It will be seen that the signal level achieved at 100 μl per minute nebulizer sample uptake is much improved over curve 204 (from about 115,000 counts per second to nearly 170,000 counts per second).

Figure 12:
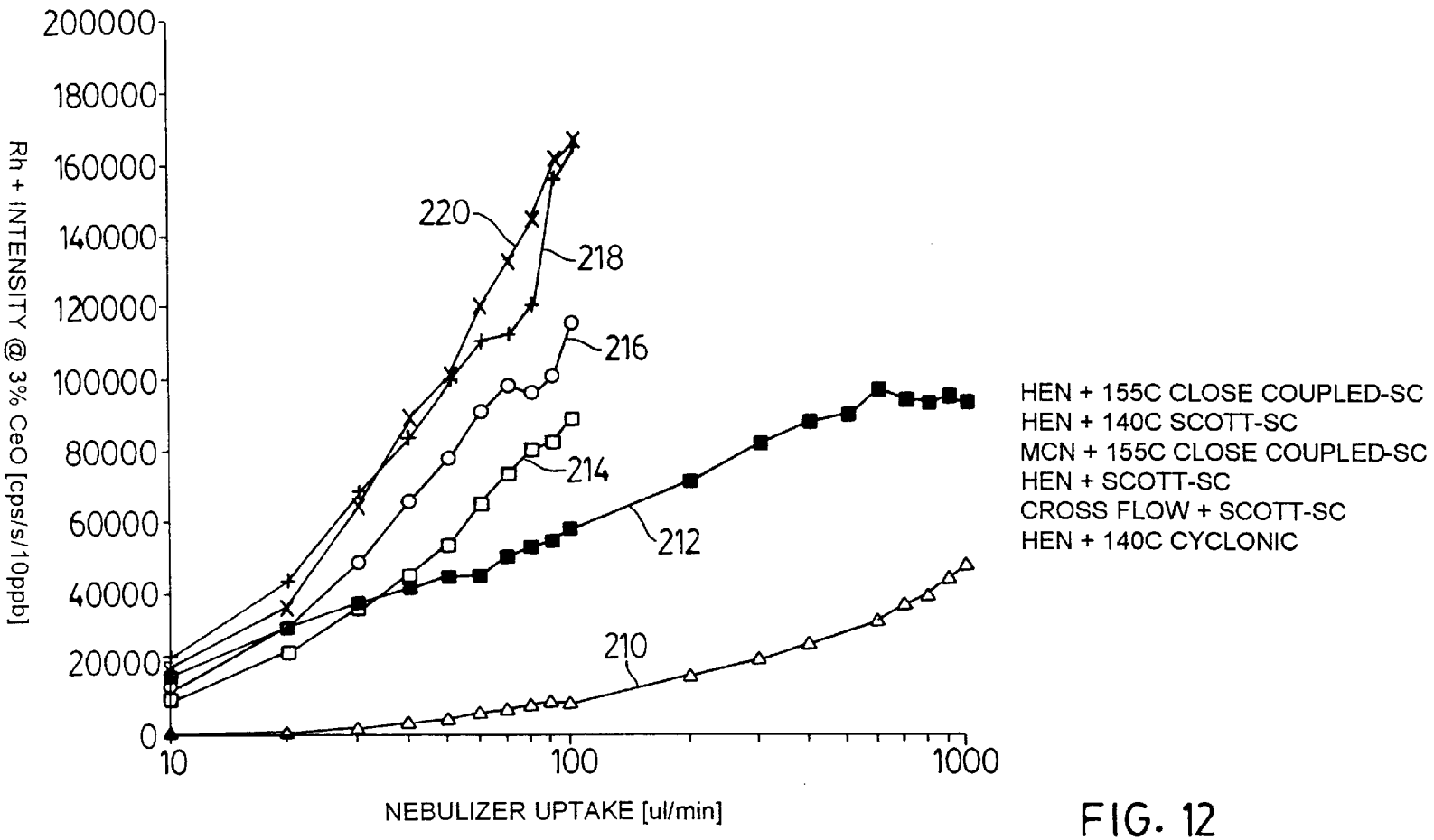
FIG. 12 is a plot similar to that of FIG. 11 and showing signal response for several nebulizers using the spray chambers of FIGS. 3A and 3B and a spray chamber according to the invention.

FIG. 12 shows a further set of curves of signal response for various spray chamber and nebulizer combinations and is similar to FIG. 11. Again in FIG. 12 the horizontal axis shows nebulizer liquid sample uptake in μl per minute, while the vertical axis shows rhodium intensity in counts per second per 10 parts per billion, in the presence of 3% cerium oxide.

In FIG. 12, curve 210 shows the signal response obtained with a conventional cross flow nebulizer and a Scott spray chamber 60 as shown in FIG. 3A. Curve 212 shows the response for a HEN nebulizer 94 used with a Scott spray chamber 60. These two curves are the same as curves 200, 202 of FIG. 11. Curve 214 shows the response for an MCN nebulizer of the kind shown at 104 in FIG. 4B, used with a spray chamber 150 as shown in FIG. 7 and with the sheath gas heated to 155° C.

Curve 216 shows the response for a HEN nebulizer used with a Scott spray chamber 60 where the outer wall of the spray chamber 60 is heated to 140° C. and corresponds to curve 204 of FIG. 11.

Curve 218 shows the response for a HEN nebulizer 94 used with a cyclonic spray chamber of the kind shown at 80 in FIG. 4B, with the outer wall of the cyclonic spray chamber heated to 140° C.

Curve 220 shows the response for a HEN nebulizer 104 used with a spray chamber 150 of FIG. 7A and with the outer wall of the spray chamber heated again to 155° C. Curve 220 corresponds to curve 206 of FIG. 10.

It will be seen that the signal levels achieved in curves 218 and 220, i.e. both using the HEN nebulizer but one using the spray chamber 150 of the invention and the other using the cyclonic spray chamber 80 heated to 140° C., were approximately the same (although the spray chamber 150 of the invention provided a modest improvement). However as will be explained in connection with FIG. 13, the washout time of the spray chamber 150 of the invention was much improved.

Figure 13:
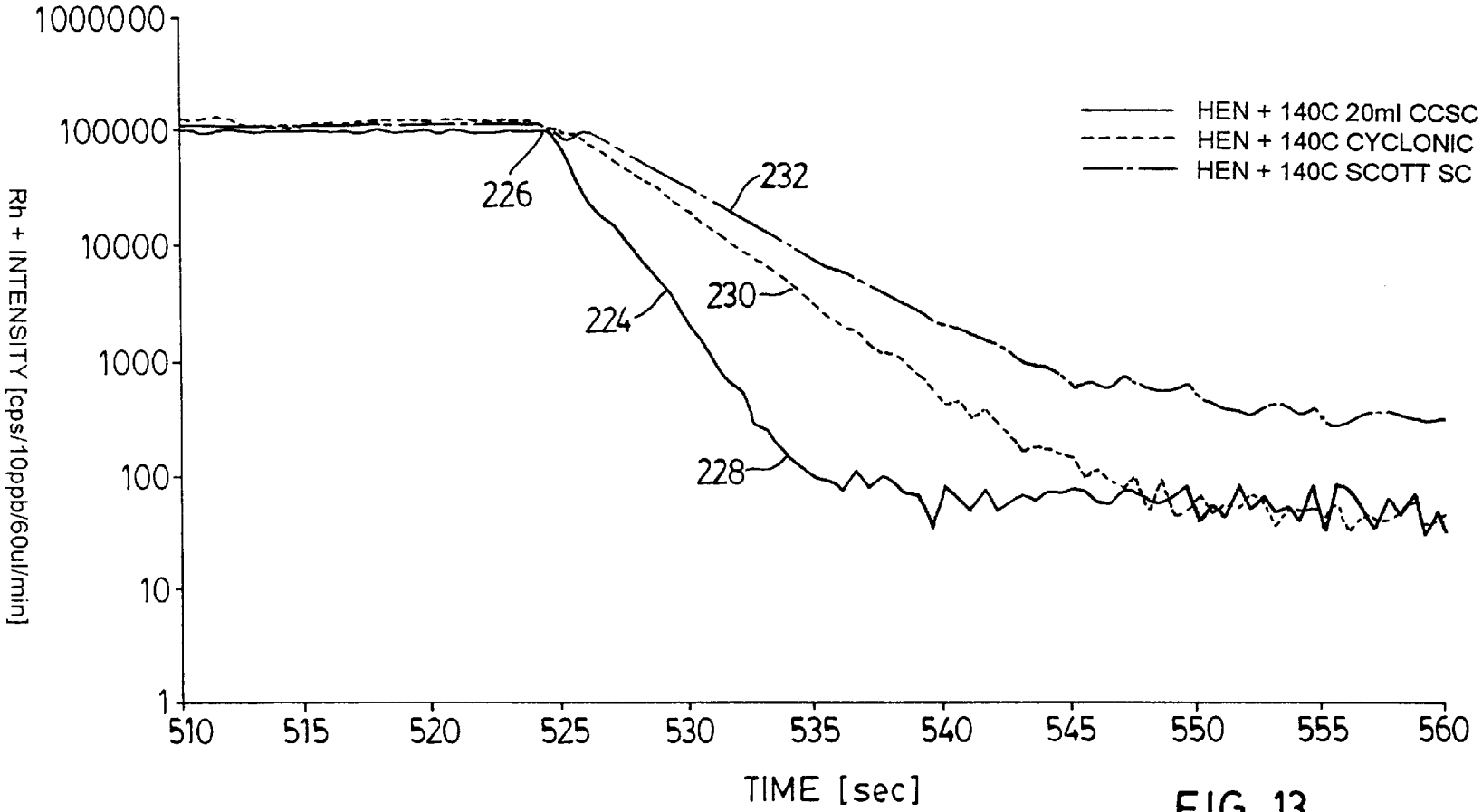
FIG. 13 is a plot showing signal washout time using a high efficiency nebulizer of the kind shown in FIG. 4A and using the spray chambers of FIGS. 3A and 3B and a spray chamber according to the invention.

FIG. 13 shows sample washout responses for a system using the HEN nebulizer 94 with three different spray chambers. Washout time is plotted on the horizontal axis while the vertical axis shows rhodium in counts per second per ten parts per billion. The sample flow and the washout flow were 60 μl per minute.

Curve 224 shows the signal response for the HEN nebulizer 94 used with the spray chamber 150 of FIG. 7A, with the sheath gas heated to 140° C. The volume of the spray chamber 150 was 20 ml. During washout, flow of sample solution through the nebulizer was replaced by a flow of distilled water, resulting in a moving interface between the sample solution and the distilled water (as is conventional). It will be seen from curve 224 that the signal level drops from 100,000 counts per second (cps) at point 226 (time approximately equals 525 seconds) to less than 100 cps at point 228 (time approximately equals 535 seconds), i.e. the washout time is approximately ten seconds.

When the HEN nebulizer is used with the cyclonic spray chamber 80 with the gas therein heated to 140° C., as shown by curve 230, the washout time for the signal level to drop to below 100 cps increases to approximately 20 seconds, or about double that of the spray chamber 150.

Curve 232 shows the washout time obtained when a HEN nebulizer 94 is used with a Scott spray chamber 60 of the kind shown in FIG. 3A, with the gas in annulus 274 thereof heated to 140° C. It will be seen that the signal level does not, at least in the time scale of the experiment, fall to the base line of 100 counts per second. This illustrates the serious memory effects which occur with a conventional Scott spray chamber.

While in FIG. 13 the cyclonic spray chamber is indicated as being heated, in practice workers in the field do not normally heat cyclonic spray chambers; instead, they tend to cool them to condense any water vapour present. However heating reduces the recirculation of droplets onto and consequent deposition of sample on the nebulizer tip.

Results similar to the washout time results occurred with signal rise time using the three spray chambers in question.

Figure 14:
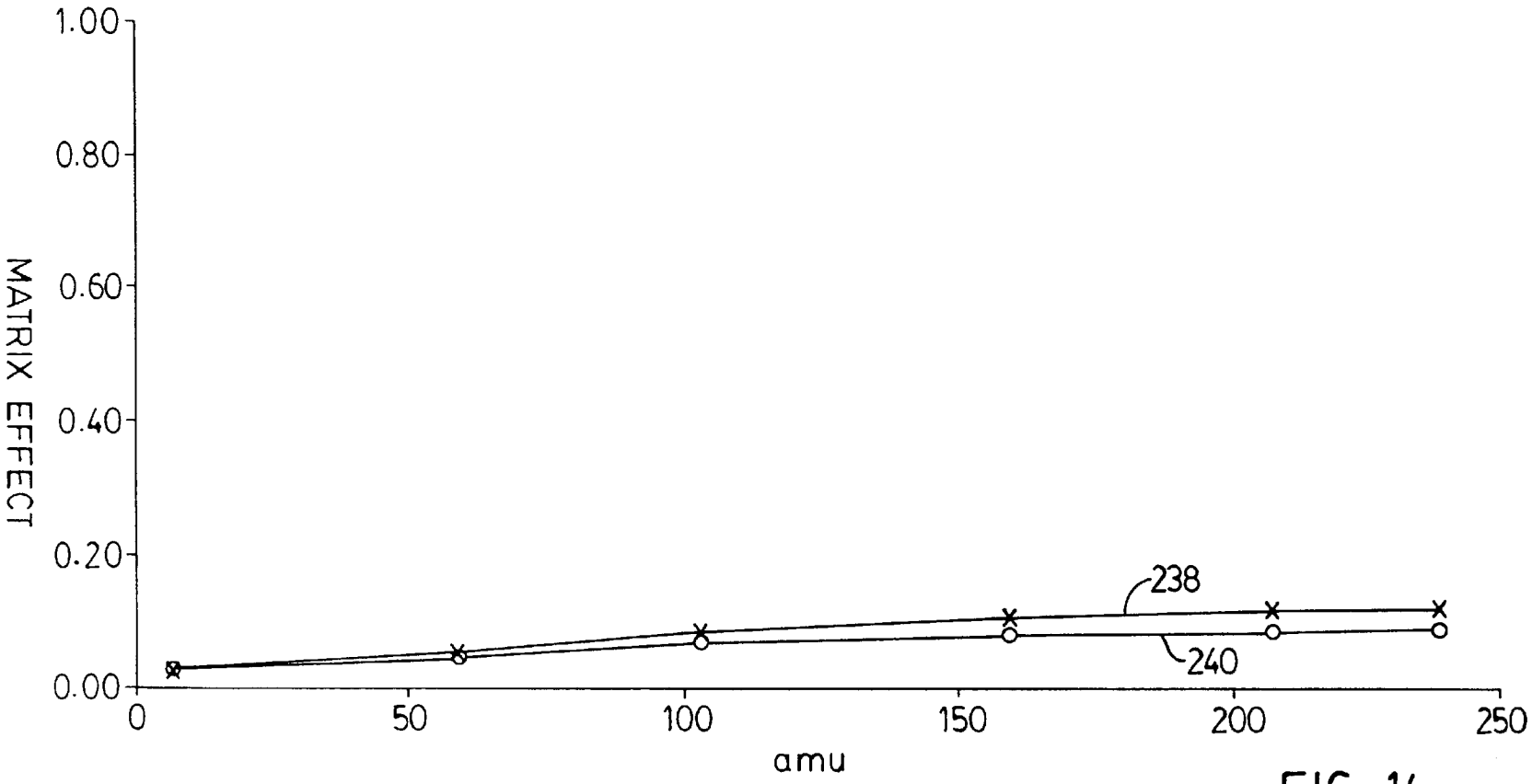
FIG. 14 is a plot showing matrix effects using the nebulizer of FIG. 4A the spray chamber of FIG. 3A and a spray chamber according to the invention.

FIG. 14 illustrates matrix effects using a HEN nebulizer 94 and a spray chamber 150 of the kind shown in FIG. 7A. A ten part per billion solution of rhodium was used with 1,000 parts per million thallium as the matrix element. Curve 238 shows the matrix effect for a HEN nebulizer 94 used with the spray chamber 150 of FIG. 7A, while curve 240 shows the matrix effect using the HEN nebulizer 94 with a Scott spray chamber 60 as shown in FIG. 3A. The spray chamber 150 was heated to 150° C., while the Scott spray chamber 60 was unheated. The presence of a matrix element normally decreases analytic signal by suppressing it, but it will be seen that heating the spray chamber did not cause significant problems as compared with the Scott spray chamber. In both cases, approximately 90% of the signal was suppressed, but there was no significant difference between the two curves 238, 240.

Figure 15:
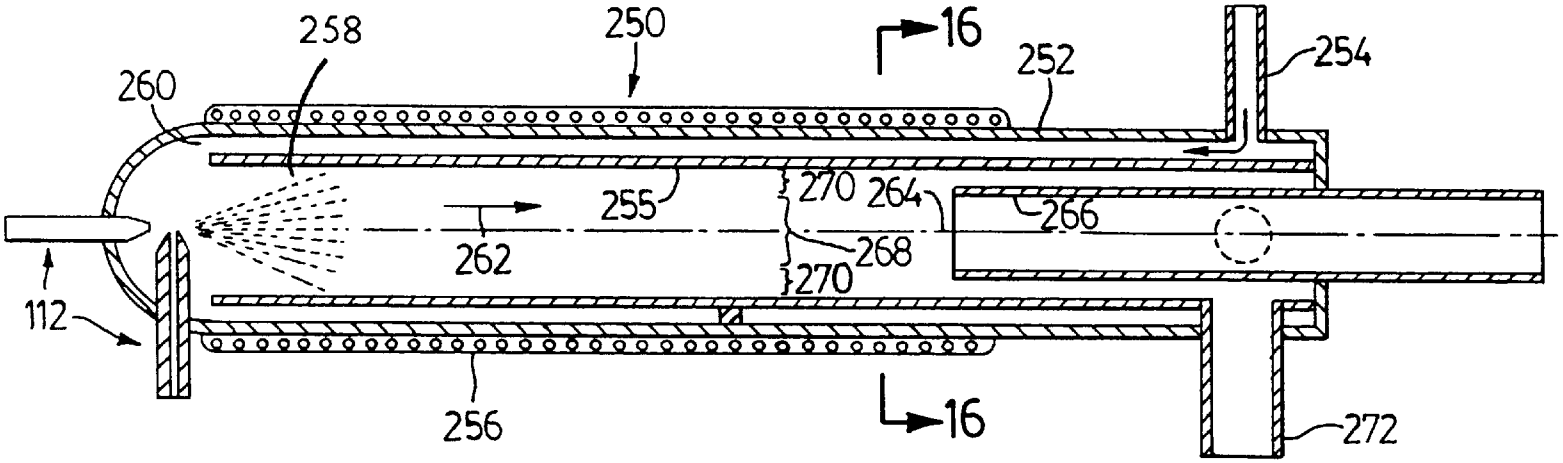
FIG. 15 is a side sectional view showing an application of the spray chamber of FIGS. 7A, 7B.
Figure 16:
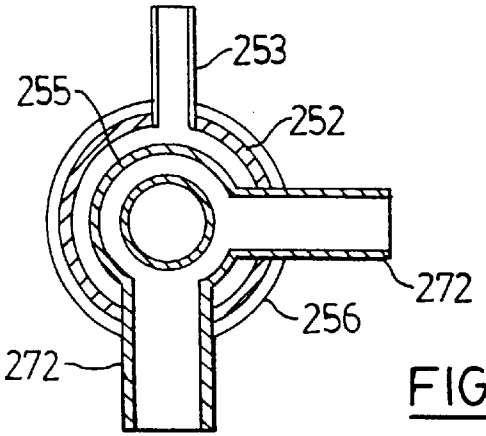
FIG. 16 is a sectional view along lines 16—16 of FIG. 15.

Reference is next made to FIGS. 15 and 16, which show an arrangement which can be used for example when sample flow rates are significantly higher than those which are usually accepted by a HEN or MCN nebulizer. For example cross flow nebulizers normally use sample flow rates of 1 ml per minute, with 1 liter per minute of argon to nebulize the liquid sample. These high flows cannot be accepted by a torch injector tube, and therefore a splitter arrangement can be used, as shown in FIGS. 15, 16.

FIG. 15 shows a cross flow nebulizer diagrammatically indicated at 112, spraying into a spray chamber 250. It is assumed as mentioned that the sample flow rate is 1 ml per minute and that the nebulizer gas flow rate is 1 liter per minute. Four liters per minute of sheath gas flow (usually argon) are introduced via outer tube 252 from a tube 254 and a sheath gas source (not shown). Tube 252 is coaxial with and surrounds the inner wall 255 of spray chamber 250. A heater tape 256 surrounding outer tube 252 heats the sheath gas to approximately 150° C. The sheath gas joins the spray 258 around the periphery of the initial part of the spray, at gap 260, as for FIG. 7A. This reduces the entrainment needs of the spray and also reduces the size of any droplets which are recirculated, as previously described.

The combined spray and sheath gas travel in the direction of arrow 262 along spray chamber 250, and are completely or partially dried by point 264. At point 264, a splitter tube 266 is introduced which serves as the torch injector tube 34. The inner core 268 of the gas (a combination of nebulizing gas, sheath gas, and dried particulates) flowing along spray chamber 250 travels through splitter tube 266 and into the torch. The outer annulus 270 between the splitter tube 266 and the inner wall 255 is removed by a waste tube 272. In the FIGS. 15 and 16 embodiment, evaporation of droplets occurs along the length of tubes 255, 266, but the walls of tube 266 remain dry because it swallows slightly less gas than that required for the plasma. It is found that the arrangement shown in FIGS. 15, 16 produces a substantially higher signal level, as compared with a conventional Scott spray chamber combined with a cross flow nebulizer. For example it can produce double the signal.

The embodiment of FIGS. 15, 16 can also be used with the spray chambers of FIGS. 7A, 7B, 9A, 9B and a HEN, MCN or other high efficiency nebulizer, where it is desired to increase the sheath gas flow beyond that which can be accepted by the torch.

It is noted that the embodiments described differ from most conventional analyzers and spray chambers where, although up to 1 ml per second of analyte is sprayed into the spray chamber, most of the analyte is wasted and typically only about 25 μl per minute reach the plasma. With most of the embodiments of the present invention, essentially all of the water in the analyte reaches the plasma. Although the water is in fully vaporized form and therefore is less likely to extinguish the plasma, the increased water vapor loading has the effect of increasing the oxide levels in the signal, which is undesirable. In addition, since the plasma can only accept a limited amount of gas, if the amount of water vapor input to the plasma is increased, the amount of argon input into the plasma must be correspondingly decreased. Since the flow of nebulizer gas cannot be decreased or the spray will suffer, this means that the flow of sheath gas must be decreased. However, such a decrease would result in less heat being input to the spray and would therefore result in poorer evaporation. As a result, spray chambers according to the invention, where all of the water vapor produced in the spray (and all the sample in the spray) have been directed into the plasma have typically been run only at nebulizer uptake rates not exceeding between about 80 and 100 μl per minute.

Figure 17:
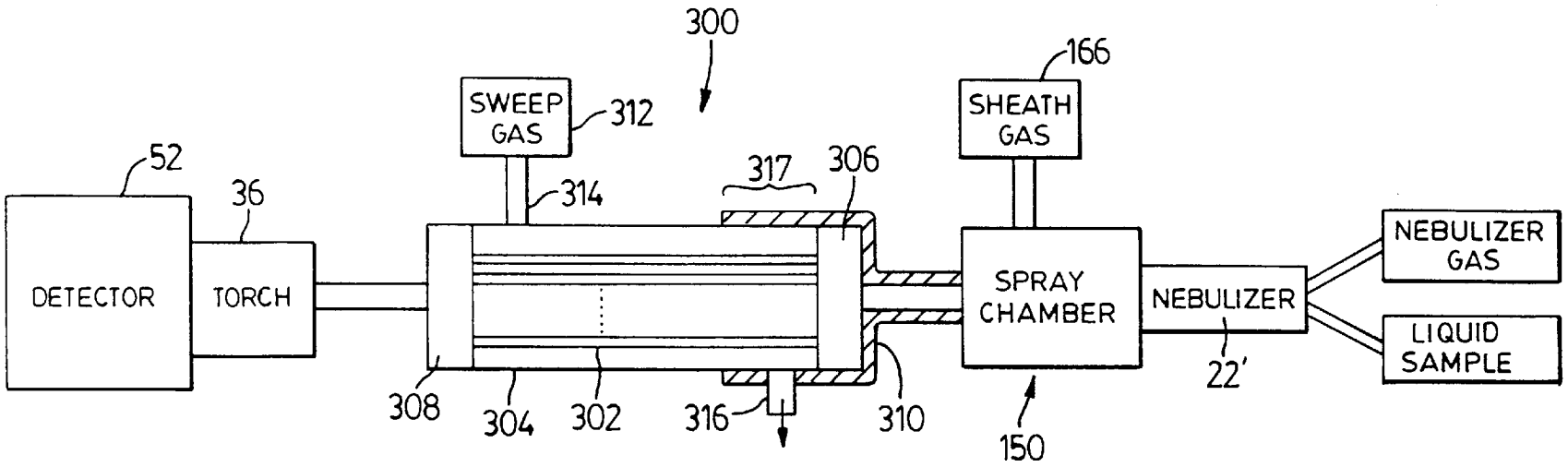
FIG. 17 us a diagrammatic view of the spray chamber of the invention incorporated into analyzer system with a dryer.
Figure 18:
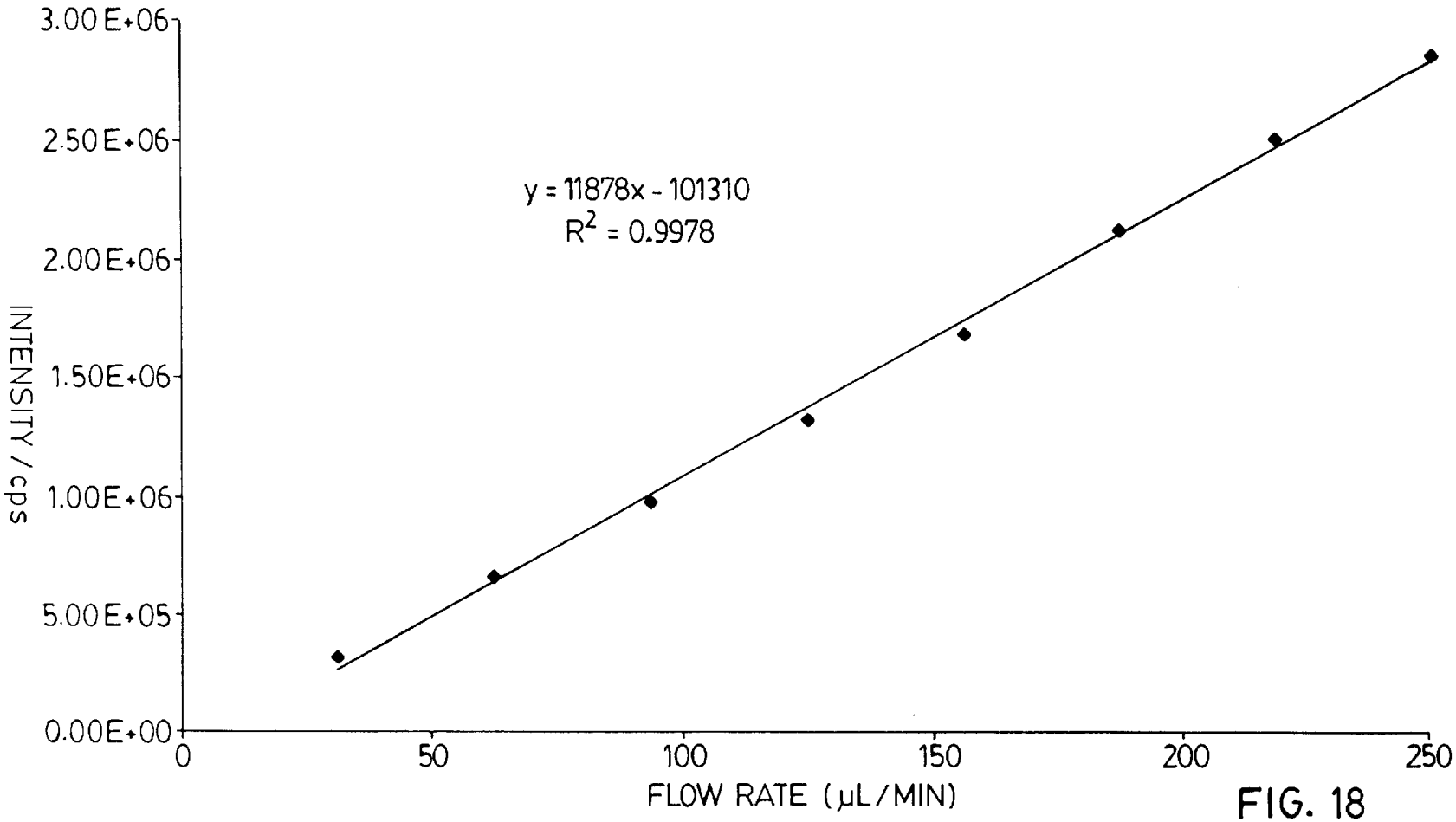
FIGS. 18–22 are plots of signal intensity versus nebulizer uptake flow rate for different elements using the system of FIG. 17.
Figure 19:
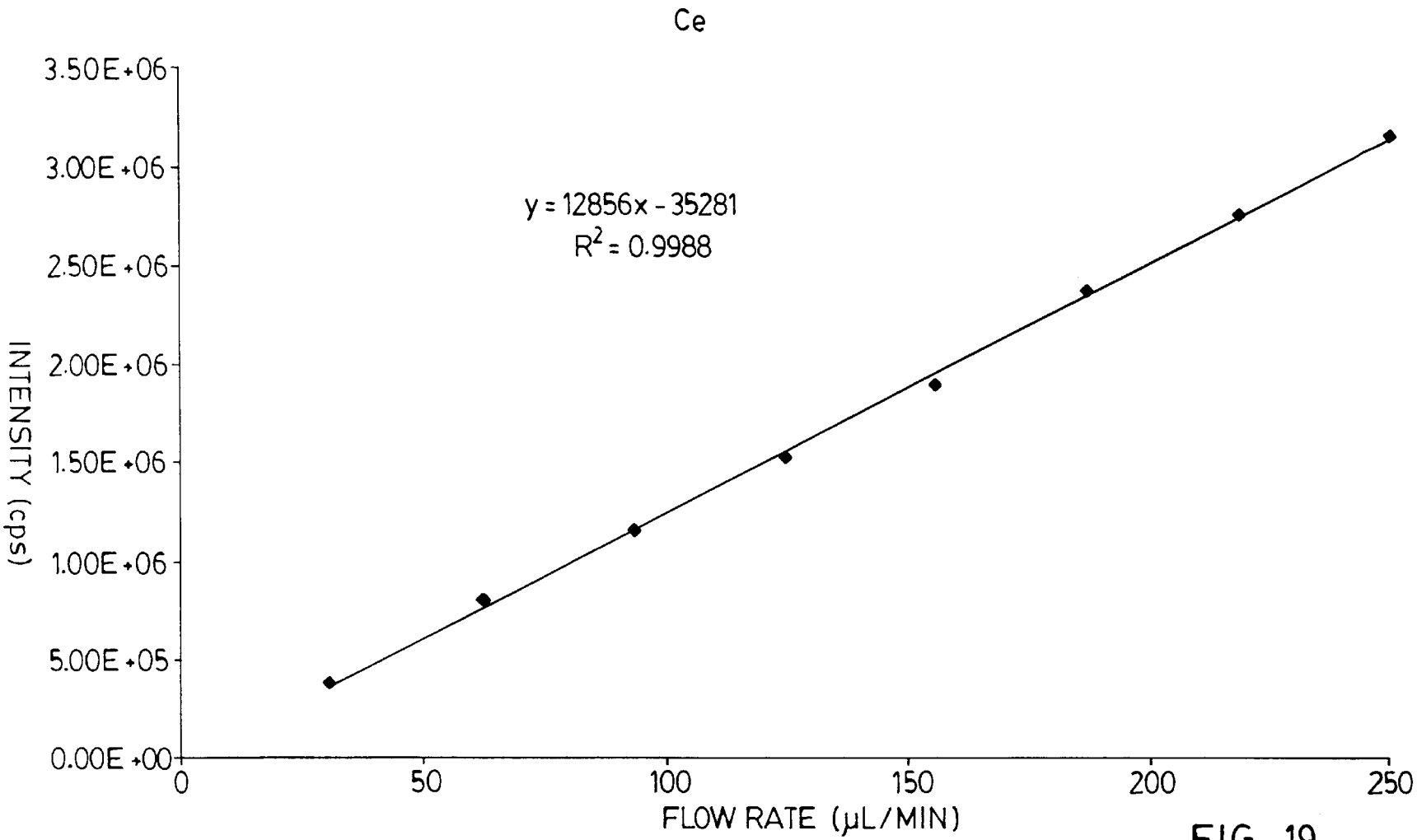
Figure 20:
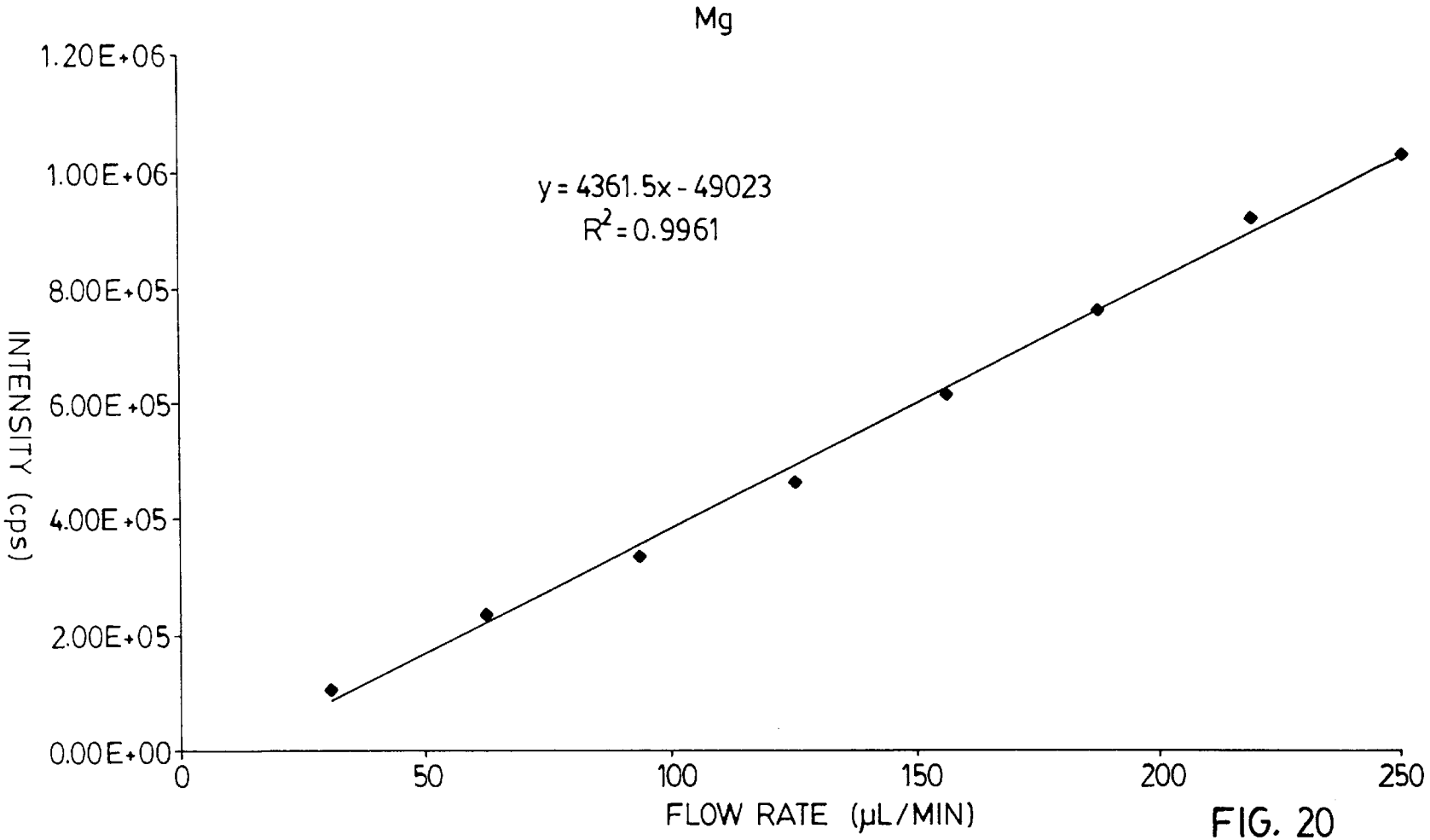
Figure 21:
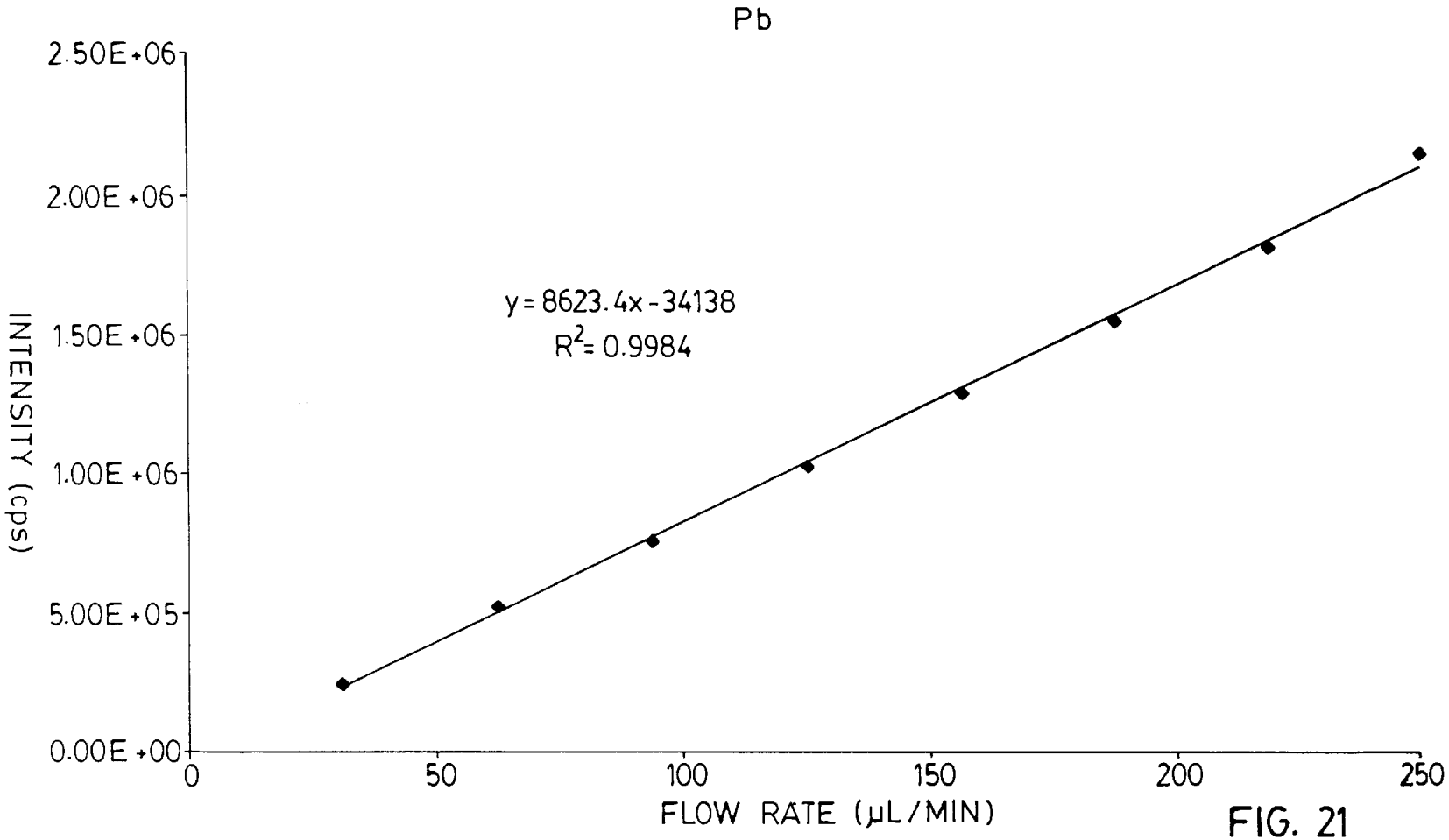
Figure 22:
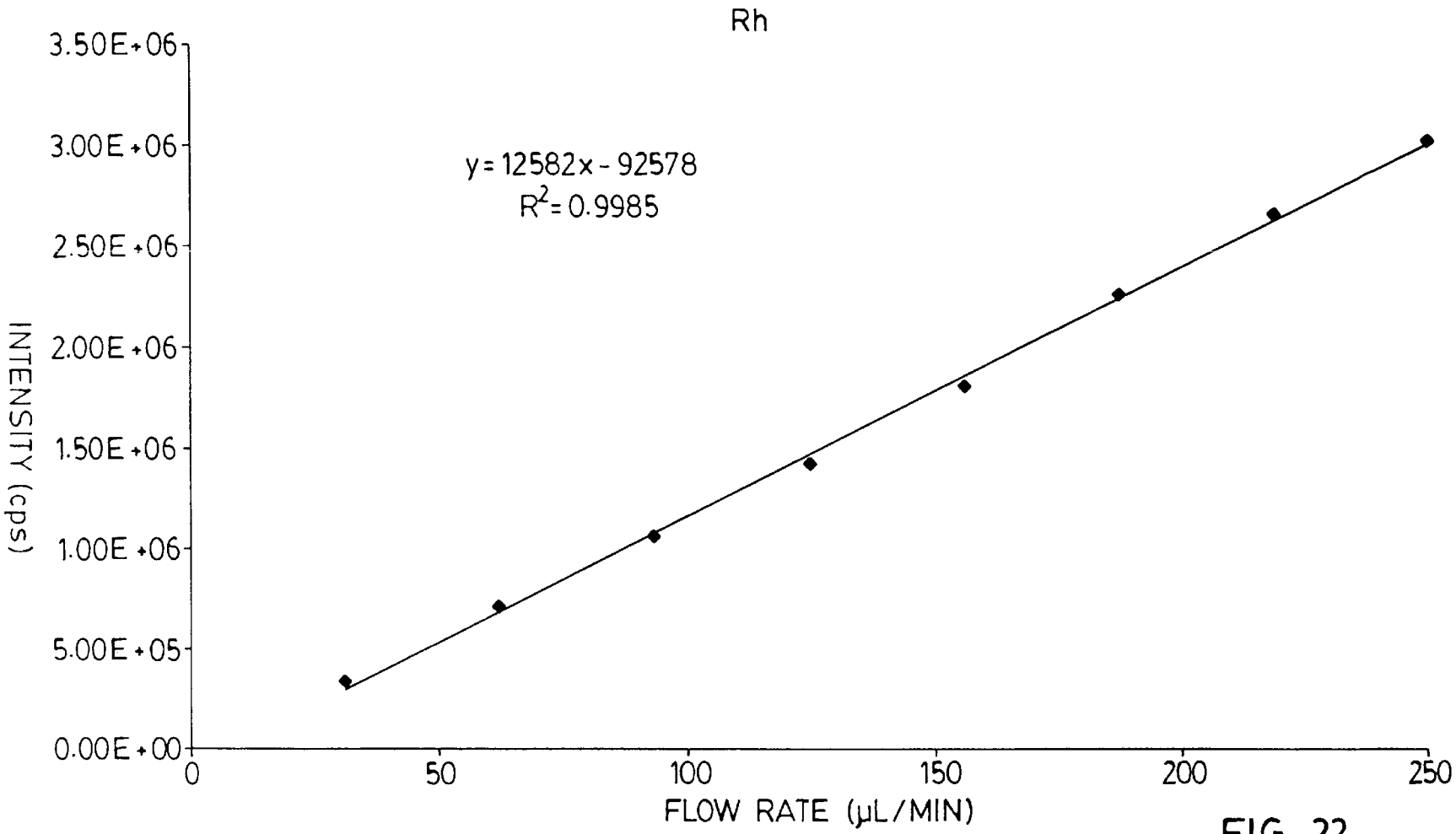

It has been discovered that these uptake rates can be increased by using a membrane dryer between the spray chamber 150 and the torch 36. Such an arrangement is shown in FIG. 17, which illustrates a dryer 300 in the position described. The dryer 300 is a conventional NAFION (™ of Dupont) membrane dryer. The substance NAFION (™) is Λ perfluoro-3,6-dioxa-4-methyl-7-octene-sulfonic acid. NAFION(™) membrane dryers are well-known for use in desolvation, as described in Spectrochimica Acta Part B 51 (1996) 1491–1503 (Elsevier Science B.V.). Materials such as NAFION(™) are known for attracting water molecules which then diffuse through the wall of the membrane and are removed by a dry counter-flowing sweep gas, as described in the above-identified article.

The dryer 300 includes a set of drying tubes 302, formed of NAFION(™). There may be any desired number of drying tubes 302. In a typical embodiment, there may be 50 such drying tubes, but the number may be increased to 100, 200 or more. The length of the tubes may be as desired, but in a typical embodiment they may be two feet long, and may have an inside diameter of 0.023 inches each.

The drying tubes 302 are contained within a housing 304 and terminate at inlet and outlet manifolds 306, 308. A gaseous stream from the spray chamber 150, containing no droplets but only fully vaporized water vapor and dried micro-particles from the analyte solution, enters the inlet manifold 306, passes through the drying tubes 302, and then travels from the outlet manifold 308 into the torch 36. Heater tapes 310 wrapped around at least the tube leading from the spray chamber 150 to the inlet manifold 306, and around the inlet manifold 306 itself, ensure that the temperature of the flowing gas stream is kept hot enough so that there is no condensation as the gas stream travels to the dryer 300.

The sweep gas (typically argon or nitrogen) from a sweep gas source 312 enters a sweep gas inlet 314 of the dryer 300 and leaves via sweep gas outlet 316. The sweep gas enters inlet 314 at room temperature, and its direction of flow is counter to the direction of the sample gas streams through the drying tubes 302, thereby "sweeping" or removing water vapor which has diffused through the drying tubes 302. The sweep gas is heated by heating tapes 310, in the upstream third of the dryer (marked at 317 in FIG. 17), to prevent condensation of the water vapor which it has picked up, and typically exits the sweep gas outlet at a temperature of about 70° C. The efficiency of such a dryer typically exceeds 90% to 96%, i.e., most of the water vapor is removed from the sample gas before it reaches the torch 36.

It is found extremely important that no water droplets be allowed to enter into the dryer 300. While others in the past have used dryers after spray chambers, they have not found any increase in sensitivity, and the inventors have determined that this was because although it was not readily apparent, some liquid water (in the form of small droplets) was entering the dryer. The water droplets entering the dryer may have a range of sizes. The droplets at the larger end of the range may impact on and wet the drying tube walls, and dry there, leaving analyte on the walls which can produce false readings and can create memory effects. Some droplets may agglomerate and clog the very small passages of the drying tube 302. Very small droplets tend to pass through the drying tubes and overload the torch with solvent and increase the oxide levels. With the spray chamber of the invention, the water vapor can be and is fully vaporized before it enters the dryer 300, producing improved results.

The improved results are shown in Table 2 below, which shows the percentage improvement in sensitivity using the spray chamber of the invention with a NAFION(™) dryer (as compared with a conventional spray chamber with nebulizer operating at 1 ml/minute). For Table 2 the spray chamber of the invention with the dryer was operated at a nebulizer uptake rate of 250 μl per minute, with the nebulizer gas flow operated at 50 psi and 0.3 liters of argon per minute, and with argon sheath gas of 0.75 liters per minute at 170° C. The sprayer was a Meinhard HEN(™) sprayer; the dryer 300 used 50 two foot long drying tubes 132, each of internal diameter 0.23 inches, and with an exit sweep gas temperature of 70° C. and a sweep gas flow of 5 liters per minute of argon.

It will be seen from Table 2 below that even at very low nebulizer uptake rates (e.g., 31 μl per minute), there was a noticeable improvement in results. It will be seen that there was no difficulty in operating the nebulizer at an uptake exceeding 100 μl per minute, even though all of the dried sample produced was directed into the torch. At high nebulizer uptake rates (250 μl per minute), the percentage improvement was between about 15 and 25 times, depending on the element being detected. In all cases, the oxide level was less than 3.0%. It appears that even higher nebulizer uptake rates (with all the resultant dried sample being directed into the torch) could be used.

TABLE 2

IMPROVEMENT IN SENSITIVITY

| Flow Rate (μL/min) | Ba | Ce | Mg | Pb | Rh |
|---|---|---|---|---|---|
| 31 | 1.84 | 1.75 | 2.65 | 1.98 | 1.73 |
| 62 | 3.86 | 3.71 | 5.76 | 4.16 | 3.61 |
| 94 | 5.71 | 5.34 | 8.16 | 6.01 | 5.42 |
| 125 | 7.67 | 7.06 | 11.23 | 8.11 | 7.25 |
| 156 | 9.84 | 8.80 | 14.97 | 10.21 | 9.21 |
| 187 | 12.41 | 11.01 | 18.61 | 12.34 | 11.58 |

TABLE 2-continued

| IMPROVEMENT IN SENSITIVITY | | | | | |
|---|---|---|---|---|---|
| Flow Rate (μL/min) | Ba | Ce | Mg | Pb | Rh |
| 218 | 14.70 | 12.86 | 22.51 | 14.44 | 13.67 |
| 250 | 16.74 | 14.73 | 25.20 | 17.14 | 15.55 |

Reference is next made to FIGS. 18 to 22, which show curves of intensity (counts per second) versus flow rate (microliters per minute) for the elements Ba, Ce, Mg, Pb and Rh, all taken under the conditions described above. It will be seen that the sensitivity increased linearly in all cases from a flow rate of about 31 μl per minute to 250 μl per minute, without the oxide problems which would normally have been encountered at the higher flow rates (e.g., above 100 μl per minute).

Figure 23:
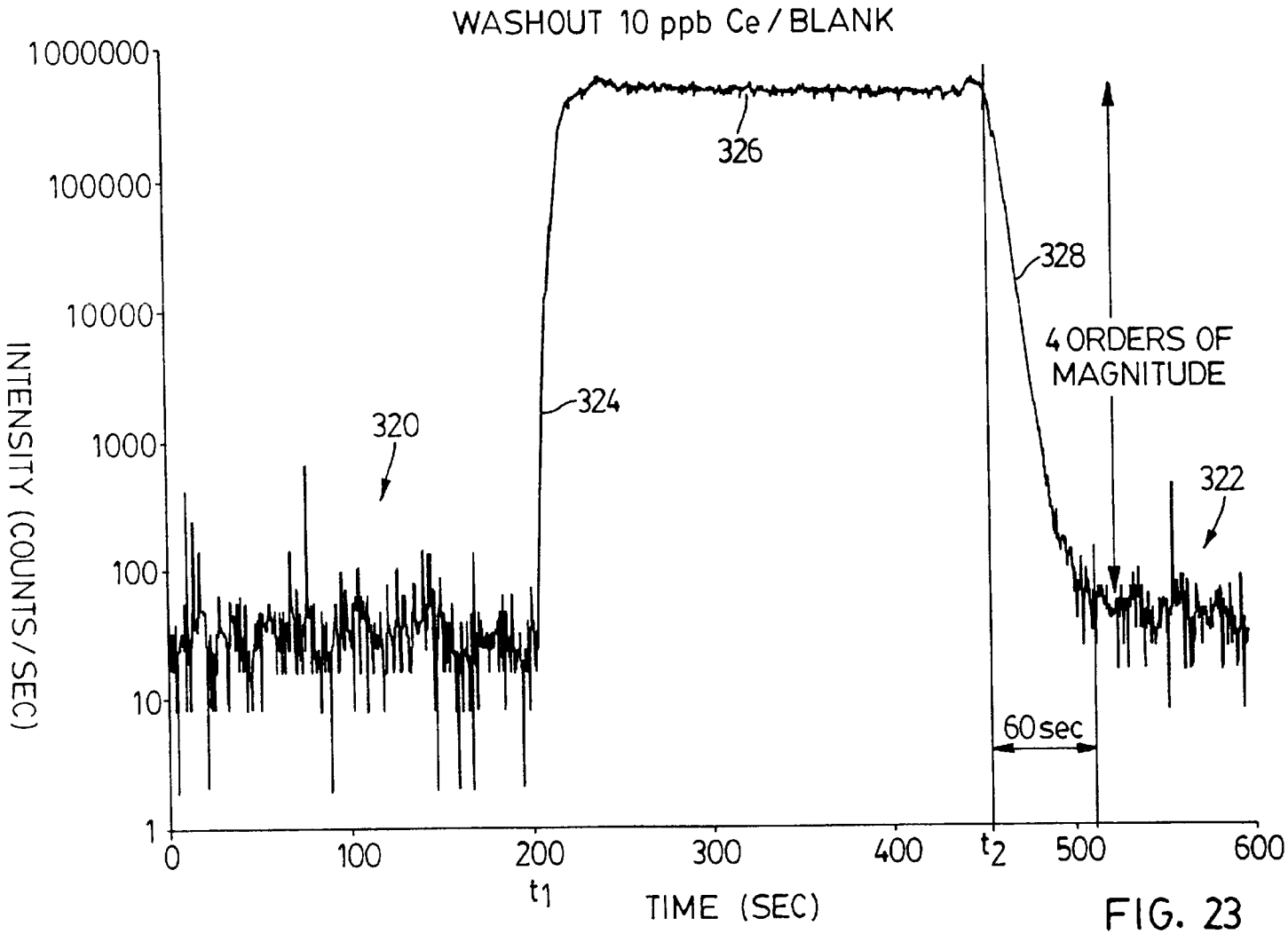
FIG. 23 is a plot showing signal washout time using the system of FIG. 17.

Reference is next made to FIG. 23, which shows a washout curve for the apparatus of FIG. 17 (with the dryer 300). Parts 320 and 322 of the curve, at its beginning and end, were obtained with a solution which did not contain any analyte. While the background was "spikey", its average level was constant.

In FIG. 23, at time $t_1$=200 seconds, a 10 ppb solution of Ce was introduced, resulting in a rapid signal rise as shown at 324 to a level 326, which held constant until time $t_2$=450 seconds. At time $t_2$ the Ce solution was replaced by a solution containing no analyte (and therefore producing a washout effect). As shown by curve segment 328, the signal then decreased rapidly and relatively linearly to the background level 322. The washout time was 60 seconds in the example given. The straight and rapid slope of the segment 328 is evidence that the interior of the spray chamber 150 and the exterior of the nebulizer tip 146 were dry, without condensation, and that the only contribution to the washout time was that associated with the spray chamber volumetric washout, with no appreciable wall wetting and attendant memory effects. This is a very important aspect of the invention, since previous desolvation devices (such as are commercially sold with ultrasonic nebulization systems) have always had much worse (longer) washout characteristics associated with them.

While NAFION(™) is a preferred material for the dryer 300, other materials can also be used, depending on the analyte solvent employed. For example, polyimide membranes may be used, such as those made by UBE Industries of Japan, or alternatively GORTEX(™) PTFE membranes may be used, as commercialized by Cetac, or even silicone rubber membranes may be used under some conditions.

While preferred embodiments of the invention have been described, it will be appreciated that various changes can be made, and all such changes which are within the scope of the invention are intended to be included within the accompanying claims.

We claim:

1. Apparatus for producing a sample for an analyzer, comprising:

(a) a nebulizer having a liquid spray tube and a nebulizer gas spray tube, for receiving a liquid sample and nebulizer gas and for producing an expanding spray of droplets of said nebulizer liquid mixed with said gas, directed in a predetermined direction, (b) a spray chamber connected to said nebulizer and having an entrance end for receiving said spray and an exit end, (c) said exit end including an outlet adapted to be coupled to said analyzer, for directing sample from said droplets and mixed with said nebulizer gas to said analyzer, (d) said spray having a periphery and having the property of tending to entrain gas surrounding said periphery into said spray, and thereby having the property, when there is insufficient gas supply surrounding said periphery, of tending to recirculate nebulizer gas and droplets from said spray in a direction opposite to said predetermined direction and then back into said spray, (e) at least one port for introducing a sheath gas into said spray chamber, and a sheath gas source connected to said port, (f) a heater for heating said sheath gas, (g) the temperature of said sheath gas being such as to dry at least partially droplets in said spray which may be recirculated, thereby to reduce agglomeration of droplets in the periphery of said spray.

2. Apparatus according to claim 1 wherein said sheath gas is introduced into said chamber in a pattern encircling said nebulizer.

3. A method according to claim 2 wherein said membrane is formed of perfluoro-3,6-dioxa-4-methyl-7-octene-sulfonic acid.

4. A method according to claim 2 wherein said spray is provided from a sample flow rate of at least 100 μl per minute, and all of said dried particulates from said spray are directed to said torch.

5. Apparatus according to claim 1 wherein at least some of said sheath gas is introduced into said chamber adjacent said nebulizer.

6. A method according to claim 1 wherein said sheath gas is heated to a temperature in the range 100° C. to 230° C.

7. A method according to claim 6 wherein said jet has an origin, and at least some of said sheath gas is directed into said spray adjacent said origin.

8. A method according to claim 1 wherein said sheath gas is heated to a temperature in the range 130° C. to 200° C.

9. Apparatus according to claim 1 wherein said spray chamber is less than about 10 cm in length.

10. Apparatus according to claim 9 wherein said spray chamber is about 7.6 cm in length.

11. A method according to claim 9 wherein said flow rate is between 100 and 250 μl per minute.

12. A method according to claim 9 wherein said flow rate is between at least 100 and 250 μl per minute.

13. Apparatus according to claim 1 wherein said spray chamber includes an outer cylindrical tube forming a wall of said spray chamber, and an interior cylindrical baffle within said outer tube, said baffle and said tube forming an annular space between them, said port being connected to said annular space for receiving said sheath gas, said baffle defining with said entrance and exit ends an interior space for said spray, said annular space communicating with said interior space.

14. Apparatus according to claim 13 wherein said baffle is formed of a substantially impermeable material and has an end defining a gap between said end and said entrance end of said spray chamber, to admit said sheath gas through said gap.

15. Apparatus according to claim 13 wherein said baffle has openings therein through which said sheath gas may flow, thus to admit said sheath gas along at least a portion of the length of said interior space.

16. Apparatus according to claim 1 wherein both said nebulizer gas and said sheath gas are argon.

17. Apparatus according to claim 1 wherein said spray chamber does not contain a drain and wherein 100 percent of said sample admitted thereto in said spray is dried.

18. Apparatus according to claim 1 wherein said analyzer includes a plasma torch.

19. Apparatus according to claim 18 wherein said spray is evaporated in said chamber to produce a combined flow of partially dried sample and nebulizer and sheath gas, said combined flow having a central core and a peripheral portion, said apparatus including a splitter, said splitter having a central tube for receiving said central core and for directing said central core to said plasma torch, said splitter further having an exterior tube surrounding said core tube for receiving said peripheral portion of said combined flow and for directing said peripheral portion to waste.

20. A method according to claim 1 wherein said membrane dryer removes at least 90% of said water vapor from said stream.

21. A method according to claim 1 wherein said sheath gas is provided in a pattern encircling said spray.

22. A method of producing a sample for an analyzer, comprising:

(a) producing a liquid spray from said sample liquid and from a jet of nebulizing gas, said spray having an expanding shape in a predetermined direction, (b) said spray having a periphery and having the property of tending to entrain gas surrounding said periphery into said spray, and thereby having the property, when there is insufficient gas supplied to said periphery, of tending to recirculate nebulizer gas and droplets from said spray in a direction opposite to said predetermined direction and then back into said spray, (c) directing a flow of sheath gas into said spray, (d) heating said sheath gas, and (e) providing said sheath gas at a temperature such as to dry at least partially droplets in said spray which may be recirculated, thereby to reduce agglomeration of droplets in the periphery of said spray.

23. A method according to claim 22 wherein said spray is formed in a spray chamber having an entrance end and an exit end, and adjusting the flows of said gases and said temperature of said sheath gas such that all of said droplets have dried before they reach the exit end of said spray chamber.

24. A method according to claim 23 and including the step of directing dried particulates from said droplets, and said sheath and nebulizing gases, to a plasma torch.

25. A method according to claim 24 and including the step of partially drying said spray to form a combined flow of partially dried spray and nebulizing gas and sheath gas, said combined flow having a central core and a peripheral portion, and directing said central core towards said plasma torch and directing said peripheral portion to waste.

26. A method according to claim 22 wherein said sheath gas is provided in a pattern encircling said spray.

27. A method according to claim 22 wherein said jet has an origin and at least some of said sheath gas is directed into said spray adjacent said origin.

28. A method of producing a sample for an analyzer, comprising:

(a) producing in a spray chamber having an entrance end and an exit end, a spray from a sample liquid and a jet of nebulizing gas, said spray being liquid and aqueous and expanding in shape in a predetermined direction from the entrance end towards the exit end, (b) said spray having a periphery and having the property of tending to entrain gas surrounding said periphery into said spray, and thereby having the property, when there is insufficient gas supplied to said periphery, of tending to recirculate nebulizer gas and droplets from said spray in a direction opposite to said predetermined direction and then back into said spray, (c) directing a flow of sheath gas into said spray, (d) heating said sheath gas, to provide a temperature of said sheath gas such as to dry at least partially droplets in said spray which may be recirculated, thereby to reduce agglomeration of droplets in the periphery of said spray, (e) adjusting the flow of gases and said temperature of said sheath gas so that all of said droplets have dried to form dried particulates before they reach the exit end of said spray chamber whereby all water vapor of said sample liquid has been fully vaporized at said exit end of said spray chamber;

(f) directing dried particulates from said droplets, and said sheath and nebulizing gases and said water vapor, in a first stream through a membrane dryer to produce a second stream in which at least some water vapor from said first stream has been removed, and (g) directing said second stream to a plasma torch.

* * * * *